United States Patent [19]

Massey et al.

[11] 4,313,737

[45] Feb. 2, 1982

[54] METHOD FOR SEPARATING UNDESIRED COMPONENTS FROM COAL BY AN EXPLOSION TYPE COMMINUTION PROCESS

[75] Inventors: Lester G. Massey, Moreland Hills, Ohio; Robert I. Brabets, Lombard; William A. Abel, Joliet, both of Ill.

[73] Assignee: Consolidated Natural Gas Service, Cleveland, Ohio

[21] Appl. No.: 127,740

[22] Filed: Mar. 6, 1980

[51] Int. Cl.[3] ..... C10L 9/08; C10L 1/32

[52] U.S. Cl. ..... 44/1 C; 44/1 SR; 44/51; 241/2; 241/24

[58] Field of Search ..... 44/1 R, 1 SR, 1 C, 51; 241/2, 17, 23, 24

[56] References Cited

U.S. PATENT DOCUMENTS

| | | | |
|---|---|---|---|
| 2,139,808 | 12/1938 | Dean et al. | 83/93 |
| 2,515,542 | 7/1950 | Yellott | 241/1 |
| 2,560,807 | 7/1951 | Lobo | 241/1 |
| 2,568,400 | 9/1951 | Kearby | 241/5 |
| 2,668,669 | 2/1954 | Skelly | 241/39 |
| 3,352,498 | 11/1967 | Schulte | 241/1 |
| 3,545,683 | 12/1970 | Schulte | 241/1 |
| 3,556,414 | 1/1971 | Eberly, Jr. | 241/2 X |
| 3,854,896 | 12/1974 | Switzer et al. | 241/23 X |
| 3,897,010 | 7/1975 | Weishaupt et al. | 241/5 |
| 3,973,733 | 8/1976 | Switzer | 241/1 |
| 3,991,943 | 11/1976 | Rohrbach | 241/23 X |
| 4,047,898 | 9/1977 | Cole et al. | 44/1 SR |
| 4,132,365 | 1/1979 | Verchuur | 241/24 X |

OTHER PUBLICATIONS

Shao Lee Soo, et al., "Final Report and Evaluation of the ILOK 4-Micron Coal Grinding Process", University of Illinois, Urbana-Champaign, Illinois, (Dec. 1976).

R. A. Glenn, et al., "A Study of Ultrafine Coal Pulverization and its Applicatin", Bituminous Coal Research, Inc., Monroeville, Pennsylvania, (Oct. 1963).

R. A. Glenn, et al., "A Study of Ultrafine Coal Pulverization and its Application-Literature Search, Jan. 1964", Bituminous Coal Research, Inc., Monroeville, Pennsylvania, (Oct. 1963).

J. F. Barkley, Hersberger and Burdick, "Laboratory and Field Tests on Coal-In-Oil Fuels", *Trans. of A.S.M.E.*, (Apr. 1944).

"NASA Technical Support Package on Screw-Extruded Continuous Coal Processing Method and Means", Jet Propulsion Laboratories, NASA Contract No. NAS-7-100, (Winter 1977).

Partha A. Ghosh, "Studies on Coal and Water Reactions near the Critical Condition of Water", submitted in partial fulfillment of the requirements for the Degree of Master of Science at the Massachusetts Institute of Technology, (Feb. 1976).

*Primary Examiner*—Carl F. Dees

*Attorney, Agent, or Firm*—Allegretti, Newitt, Witcoff & McAndrews

[57] ABSTRACT

A process for the fractionation of a porous or fluid-permeable hydrocarbonaceous solid, such as coal, containing an admixture of mineral matter and hydrocarbonaceous matter, into a separate mineral enriched fraction and a separate hydrocarbonaceous enriched fraction is disclosed. In this process, the hydrocarbonaceous solid is comminuted to convert the hydrocarbonaceous matter in the coal into discrete particles having a mean volumetric diameter of less than about 5 microns without substantially altering the size of the mineral matter originally present in the coal. As a result of this comminution, the hydrocarbonaceous particles can be fractionated from the mineral particles to provide a hydrocarbon fraction having a lesser concentration of minerals than in the original uncomminuted material and a mineral fraction having a higher concentration of minerals than in the original uncomminuted material.

A preferred method for comminuting the porous or fluid-permeable hydrocarbonaceous solid, i.e. coal, is to first form a slurry of coal and a fluid such as water. This slurry is then heated and pressurized to temperatures and pressures in excess of the critical temperature and pressure of the fluid.

The resultant supercritically heated and pressurized slurry is then passed to an expansion zone maintained at a lower pressure, preferably about ambient pressure, to effect comminution or shattering of the solid by the rapid expansion or explosion of the fluid forced into the coal during the heating and pressurization of the slurry.

The supercritical conditions employed produce a shattered product comprising a mixture of discrete comminuted hydrocarbonaceous particles having a volumetric mean particle size equivalent to less than about 5 microns in diameter and discrete inorganic and mineral particles having a mean particle size substantially unchanged from that in the original solid. This mineral fraction, in turn, is then fractionated from the hydrocarbonaceous fraction.

42 Claims, 13 Drawing Figures

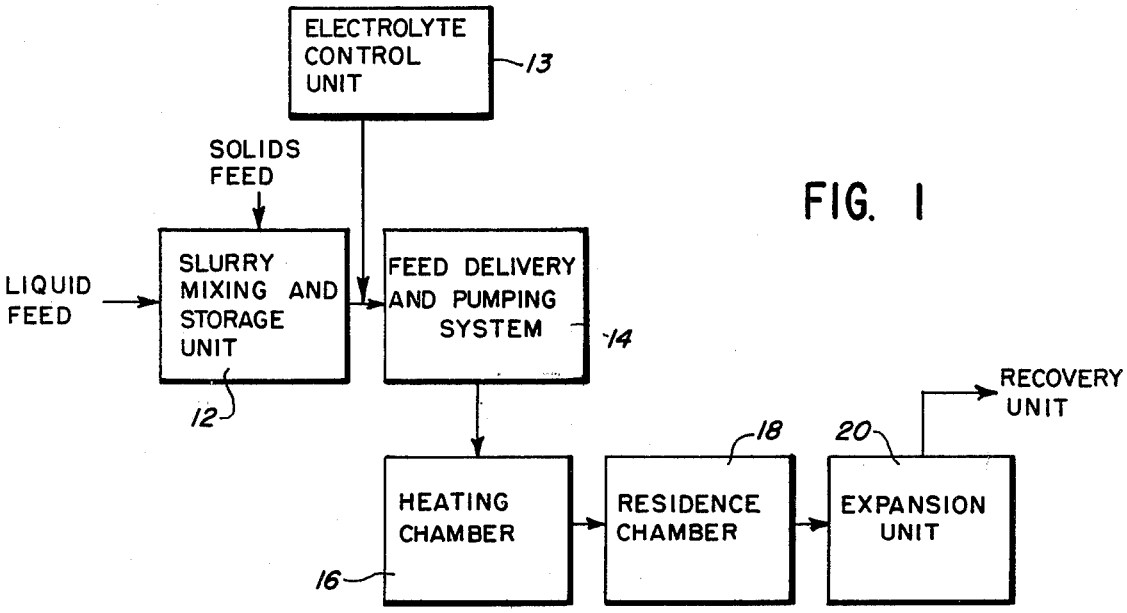
FIG. 1
FIG. 4
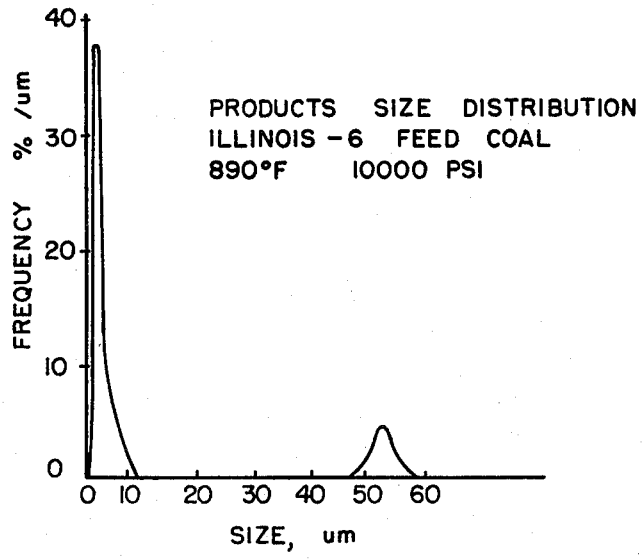

SHATTERED PRODUCT SIZE, ILLINOIS-6 COAL, AS FUNTION OF TEMPERATURE AND PRESSURE

SHATTERED PRODUCT SIZE, PITTSBURGH-8 COAL, AS FUNCTION OF TEMPERATURE AND PRESSURE

COAL SEPARATION SYSTEM

HEATER SYSTEM

*AIR OXIDATION THERMOGRAMS*

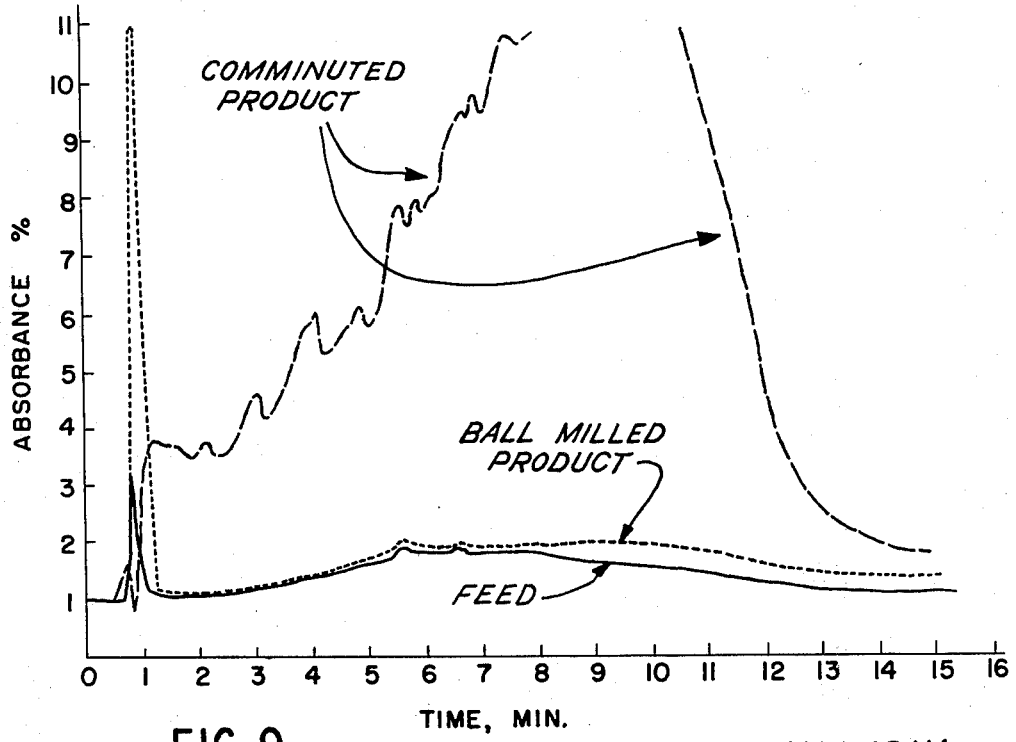
FIG. 9 METHANOL EXTRACTION CHROMATOGRAM
ILLINOIS - 6
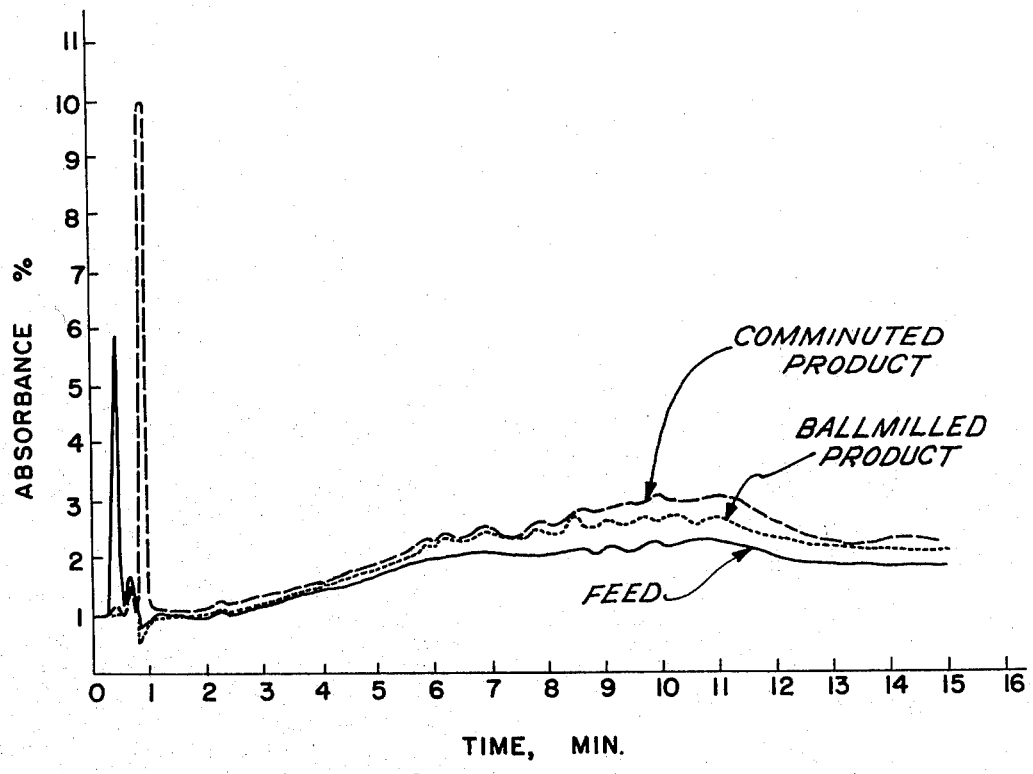
FIG. 10 METHANOL EXTRACTION CHROMATOGRAM
PITTSBURGH - 8

LOCATION OF ILLINOIS-6 COAL, EXPLOSIVE SHATTERING DATA

SUPERPRESSURIZED WATER VS. SUPERCRITICAL CONDITIONS FOR EXPLOSIVE SHATTERING OF ILLINOIS-6 COAL – 1 MINUTE RESIDENCE TIME (SIZE/TEMP PLOT)

SUPERHEATED STEAM VS. SUPERCRITICAL CONDITIONS FOR EXPLOSIVE SHATTERING OF ILLINOIS-6 COAL 1 MINUTE RESIDENCE TIME (SIZE/TEMP. PLOT)

METHOD FOR SEPARATING UNDESIRED COMPONENTS FROM COAL BY AN EXPLOSION TYPE COMMINUTION PROCESS

BACKGROUND OF THE INVENTION

The expanding need for energy combined with the depletion of known crude oil reserves has created a serious need for the development of alternatives to crude oil as an energy source. One of the most abundant energy sources, particularly in the United States, is coal. Estimates have been made which indicate that the United States has enough coal to satisfy its energy needs for the next two hundred years. Much of the available coal, however, contains significant amounts of inorganic ash forming minerals, such as quartz and clay, and sulfur compounds, such as pyrites and organic compounds in admixture with the hydrocarbonaceous portion of the coal, which create serious pollution problems when burned. The amount of sulfur and ash forming mineral components in coal varies. However, virtually all types of coal contain such impurities and potential pollutants to some degree entrapped within the coal as mined. As a result, expensive pollution control equipment is usually required as part of any installation using coal as a fuel. The added cost of this equipment seriously detracts from and restricts the use of coal as an energy source.

To overcome the pollution problems associated with the combustion of coal, techniques have been developed for converting coal into liquids or gases from which the potential pollutants, i.e. sulfur, can be removed. For example, coal can be gasified into methane, water gas, and other combustible gases whereby the mineral matter contained in the coal is substantially removed during the gasification process. The sulfur containing pollutants, however, still remain in the resultant gaseous products and must be removed from these products by a separate processing step.

U.S. Pat. No. 3,850,738 issued to Stewart, Jr. et al provides another example of the conversion of coal to more valuable products. In this process, coal is contacted with water at high temperatures and pressures to thermally crack the hydrocarbonaceous material in the coal into aralkanes, gaseous hydrocarbons and undissolved ash.

Another technique for increasing the availability and use of raw coal involves the comminution of coal into a fine particle size in an effort to separate the coal into discrete component parts. One method of comminution, known as chemical comminution is illustrated in U.S. Pat. No. 3,850,477 issued to Aldrich et al involves weakening the intermolecular forces of the coal particles by anhydrous ammonia or other suitable chemicals.

Another method of comminution involves mechanical comminution or grinding. In this method, the grinding is effected by ball or jet milling or any other techniques wherein the coal particles impinge against or are contacted with a solid obstruction. Jet milling, for example, involves entraining coal particles in a gas stream at high velocity and directing the gas stream against a solid obstruction. Examples of jet milling are shown and described in Switzer, U.S. Pat. No. 3,973,733 and Weishaupt et al, U.S. Pat. No. 3,897,010. Specific examples of such jet milling devices include the "Micronizer" brand fluid energy mill manufactured by Sturtevant Mill Company and the "Jet-O-Mizer" fluid energy reduction mill produced by the Fluid Energy Processing and Equipment Company. These devices are described in an article, R. A. Glenn et al, *A Study of Ultra-fine Coal Pulverization and its Application,* pp. 20, 90 (October 1963), distributed by the National Technical Information Service, U.S. Department of Commerce, 5285 Port Royal Road, Springfield, Va. 22151. Mechanical comminution techniques are frequently used, for example, to provide feed coal to a gasification reactor.

Ball milling, jet milling and other mechanical impingement techniques involve relatively crude forms of comminution. First, and most importantly, these techniques do not comminute selectively; that is, they comminute the ash forming minerals as well as the valuable hydrocarbon portion of the coal. Another disadvantage is that the mechanical or grinding techniques do not separate or scission the hydrocarbonaceous matter within the coal from the mineral constituents of the coal. That is, ash forming materials generally remain physically attached to the hydrocarbonaceous material in the coal, after milling, to a considerable extent. The minerals thus cannot be removed from the desired hydrocarbonaceous particles. In addition, organic forms of sulfur remain chemically bonded in the hydrocarbon. As a result, it is difficult to isolate the hydrocarbon from the pollutants. Second, these techniques are limited in their degree of size reduction. Ball milling and jet milling and other mechanical impingement techniques cannot effectively comminute coal, for example, to a mean particle size of less than about 2 microns[1] because of the inherent elasticity of the coal.

[1] As used herein, a micron is equivalent to a micrometer or $10^{-6}$ meter.

A third comminution method involves the explosive comminution of coal. This method, generally used with permeable, porous or microporous, friable solid materials, involves creating strong internal stress within the solid by forcing a fluid into the pores and/or micropores of the solid material at elevated temperature and/or pressure and then subjecting the material to rapid depressurization. The fluid within the pores and micropores thus expands very rapidly, thereby rupturing or exploding the coal into smaller particles.

The explosive comminution of solid materials has been investigated in connection with various fluids, temperatures, pressures, and operating designs. Singh, U.S. Pat. No. 2,636,688; Kearby, U.S. Pat. No. 2,568,400; and Yellott, U.S. Pat. No. 2,515,542 teach the use of gases such as air or steam as the comminuting fluid in connection with pressures between about 15 and about 750 pounds per square inch absolute (psia) and temperatures below the softening point of the coal. Schulte, U.S. Pat. No. 3,342,498; and Schulte, U.S. Pat. No. 3,545,683 teach the use of gases such as steam between about 500 and about 3,000 psia and between about 100° and about 750° F. not to comminute coal but to shatter ores. Lobo, U.S. Pat. No. 2,560,807; and Dean et al, U.S. Pat. No. 2,139,808 teach the use of a pressurized liquid such as water preferably below about 200 psia. Stephanoff, U.S. Pat. No. 2,550,390 teaches an explosive comminution reactor producing a product with a mean particle diameter of about 24 microns which is combined with a jet milling reactor to produce a final product with mean particle diameter of about 5 microns. Explosive comminution is also taught in Snyder, U.S. Pat. No. 3,895,760; and Ribas, U.S. Pat. No. 3,881,660.

Finally, the Jet Propulsion Laboratory (JPL) in Pasadena, Calif. has also conducted research on the feeding of coal into high pressure reactors. This research involves plasticizing solid coal at high temperatures and pressures, then screw extruding the resultant mass at high pressure through a nozzle. Fine particles are, as a result, sprayed into a reactor. This work is described in "Technical Support Package on Screw-Extruded Coal Continuous Coal Processing Method and Means", for NASA Tech. Brief, Winter 1977 (updated April 1978), Vol. 2, No. 4, Item 33, prepared by W. P. Butler.

SUMMARY OF THE INVENTION

It is an object of the present invention to provide a method for fractionating a porous hydrocarbonaceous solid such as coal containing an admixture of hydrocarbonaceous components and mineral components into a hydrocarbonaceous enriched fraction and a mineral enriched fraction, preferably without the use of chemical reactions.

It is a further object of the present invention to provide a method for scissioning the hydrocarbonaceous components contained in a porous hydrocarbonaceous solid such as coal from the mineral components contained in the hydrocarboaceous solid.

It is another object of the present invention to provide a method for selectively comminuting the hydrocarbonaceous material within a porous or fluid-permeable hydrocarbonaceous solid such as coal containing mineral matter into a comminuted product without comminution of the mineral matter contained within the hydrocarbonaceous solid.

It is still another object of the present invention to provide a novel form of solid hydrocarbonaceous matter from a naturally occurring hydrocarbonaceous solid containing an admixture of hydrocarbonaceous components and mineral components, such as coal, wherein this novel form of hydrocarbonaceous solid has both chemical and physical properties different from the hydrocarbonaceous solid from which it was produced and a reduced mineral concentration.

We have discovered that there is an advantage associated with the explosive comminution of coal which can be used to produce selective comminution of the hydrocarbonaceous particles from the mineral particles in the coal. Specifically, the hydrocarbonaceous component of the coal is a porous, fluid-permeable solid whereas the mineral component of the coal is a relatively crystalline, fluid-impervious solid. As a result, the hydrocarbonaceous components of the hydrocarbonaceous solids, e.g. coal, are the only components of the coal which are comminuted by an explosive comminution of the solid. It has been discovered that if certain conditions are employed in the explosive comminution of a hydrocarbonaceous solid such as coal, the mineral particles in the coal are scissioned from the hydrocarbonaceous components contained therein and that ultrafine hydrocarbonaceous particles are produced without substantially reducing the size of the mineral matter within the coal. This permits the isolation or fractionation of the valuable hydrocarbonaceous particles from the undesirable ash-forming and pollutant-forming mineral particles.

In a broad embodiment therefore, the present invention relates to a method for fractionating a porous hydrocarbonaceous solid containing an admixture of hydrocarbonaceous and mineral components into a hydrocarbonaceous enriched fraction and a mineral enriched fraction. Preferably, the hydrocarbonaceous fraction has a substantially reduced mineral content and the mineral fraction contains the majority of the minerals originally present in the original solid. This method includes the comminution of the hydrocarbonaceous components of the hydrocarbonaceous solid such as coal selectively without substantially comminuting the mineral components therein under conditions sufficient to scission the hydrocarbonaceous components from the mineral components and to produce a mixture of comminuted discrete hydrocarbonaceous particles in admixture with discrete mineral particles wherein the volumetric mean particle size of the comminuted hydrocarbonaceous particles is less than about 5 microns in diameter and the mean particle size of the mineral particles both before and after the comminution is substantially unchanged. This selective comminution in combination with the differences in size and density of the hydrocarbonaceous particles and the mineral particles permits the hydrocarbonaceous fraction to be then fractionated from the mineral fraction, preferably by gravity separation to thereby provide, as indicated, a hydrocarbonaceous enriched fraction and a mineral enriched fraction.

A particularly preferred method of comminuting the porous hydrocarbonaceous solid such as coal is to first provide a slurry of the hydrocarbonaceous solid in a liquid, preferably water, at a pressure and temperature in excess of the critical pressure and temperature of the liquid. The pressure imposed on the slurry is then rapidly reduced, preferably instantaneously, to thereby cause the liquid to expand explosively and thereby selectively comminute the hydrocarbonaceous components in the solid and to provide a scissioning of the hydrocarbonaceous components from the mineral components.

As indicated, a preferred embodiment of the present invention includes the rapid, e.g. explosive, expansion of a slurry of a hydrocarbonaceous solid, e.g. coal, initially maintained at supercritical temperatures and pressures. Supercritical conditions are necessary so that the fluid, e.g. water, which fills the coal pores becomes a high energy, dense fluid. The dense fluid mass forms a column of fluid within the pores of the coal, the inertia of which is sufficient to prevent the fluid from gradually escaping the pores during the extremely rapid, e.g. instantaneous, depressurization. As a result, the fluid expands rapidly, if not instantaneously, thereby causing the coal to literally explode. Less dense fluids, e.g. vapors, at subcritical temperatures and pressures do not have sufficient mass and energy to fully provide this effect. For example, although water vapor maintained in the pores of the coal at subcritical conditions will provide some shattering, the mean particle size of the resulting product remains relatively large and, as a result, there is little scissioning of the hydrocarbonaceous components from the mineral components of the coal in comparison to the results obtained by explosions from supercritical conditions.

As used in the description of a preferred embodiment of the present invention, the "critical point" of a liquid refers to the temperature and pressure at which the vapor phase and the liquid phase of the liquid can no longer be distinguished, i.e. the phases merge. "Critical temperature" refers to the temperature of the liquid-vapor at the critical point, that is, the temperature above which the substance cannot be liquefied at any pressure. "Critical pressure" refers to the vapor pressure of the liquid at the critical temperature. "Critical phenomena" refers to the physical properties of liquid and gases at the critical point. A liquid which has been pressurized above its critical pressure and heated above its critical temperature will be referred to as a "supercritical fluid". The critical point of water occurs at about 3205 psia and about 705° F.

The explosive comminution of coal according to the preferred embodiment of the present invention requires the formation of a mixture of coal and sufficient water to permit the water to permeate the pores of the coal such as is obtained by the formation of a slurry of coal and water.

The pressure and temperature to which the slurry is subjected are preferably less than about 16,000 psia and about 1,000° F., respectively. These upper limits, however, are primarily determined by design safety considerations based on known current materials and methods of construction only. Preferred pressures are between about 4,000 psia and about 16,000 psia. Particularly preferred pressures are between about 6,000 psia and about 15,000 psia. Preferred temperatures are between 750° F. and about 950° F.

The slurry is preferably maintained at the preferred temperature and pressure for a short period of time. The exact time is determined primarily by the exact temperature and pressure imposed on the slurry. At the preferred operating conditions, the time period is less than about 15 seconds. In any event, the time should not permit the fluid, e.g. water, to dissolve the mineral components of the coal to a substantial degree.

Finally, the pressure of the slurry is rapidly reduced from the initial pressure imposed on it to a second predetermined pressure. The second predetermined pressure is substantially below the critical pressure of the fluid, preferably near ambient pressure, i.e. less than about 75 psia. The temperature of the slurry drops, as a result of the energy associated with the expansion of the fluid, to a second predetermined temperature and preferably above the dew point of the water at the second pressure. At ambient pressure, the preferred temperature is above about 250° F. and is preferably about 260°-300° F. The reduction in pressure is substantially instantaneous so that the pressurized fluid within the coal pores cannot escape gradually. Preferably, the pressure reduction takes place within less than about 100 microseconds, more preferably within less than about 10 microseconds and most preferably within less than about 1 microsecond to thereby effectively shatter the coal and to provide a hydrocarbonaceous fraction readily separable from the mineral fraction of the coal.

In a further embodiment, the present invention provides a material produced from the selective comminution of coal having distinct, separable fractions comprising a hydrocarbonaceous fraction consisting essentially of discrete particles of hydrocarbonaceous material having a volumetric mean particle size of less than about 5 microns in diameter and a mineral fraction consisting essentially of discrete particles of mineral matter having a volumetric mean particle size substantially unchanged from the original material. Typically, the volumetric mean particle size of the minerals is greater than about 5 microns in diameter in both the original material and the comminuted material.

In a specific embodiment of the present invention, a hydrocarbonaceous material derived from coal is provided, being relatively free of mineral components and having a volumetric mean particle size of less than about 5 microns. This material is further characterized as having: a density of about 0.7 to about 0.9 grams per cubic centimeter, i.e. about 50 to about 75% of the density of known forms of coal; a solubility in a solvent, selected from the group consisting of gasoline, benzene, methyl alcohol, carbon tetrachloride and tetralin, about 2 times to about 6 times greater than the solubility of the original coal; a subfraction of discrete hydrocarbonaceous particles substantially free of sulfur and having a mean volumetric particle size of less than about 2 microns in diameter; and an oxidation decomposition rate, determined by thermogravimetric analysis at ambient atmosphere, which includes a first peak at about 300° C. and a second peak between about 350° and 450° C. wherein the decomposition rate decreases to substantially zero between the first and second peaks. The reactivity to oxygen is distinctly greater than for the untreated coal.

These and other objects, advantages and features of the invention will be set forth in the detailed description which follows.

BRIEF DESCRIPTION OF THE DRAWINGS

In the detailed description which follows, reference will be made to the following figures:

FIG. 1 is a block diagram of the basic steps utilized in a preferred embodiment of the process of the present invention.

FIG. 4 is a graph showing the product size distribution for an explosively shattered Illinois-6 coal at specific temperatures and pressures in accordance with the present invention.

FIG. 9 is a graph comparing high performance liquid chromatagraphs of methanol extracts of Illinois-6 coal prepared from (a) raw feed, (b) a prior art ball milled product and (c) an explosively shattered product produced in accordance with the present invention.

FIG. 10 is a graph comparing high performance liquid chromatographs of methanol extracts of Pittsburgh-8 coal prepared from (a) raw feed, (b) a prior art ball milled product and (c) an explosively shattered product produced in accordance with the present invention.

DESCRIPTION OF THE PREFERRED EMBODIMENTS

Figure 2:
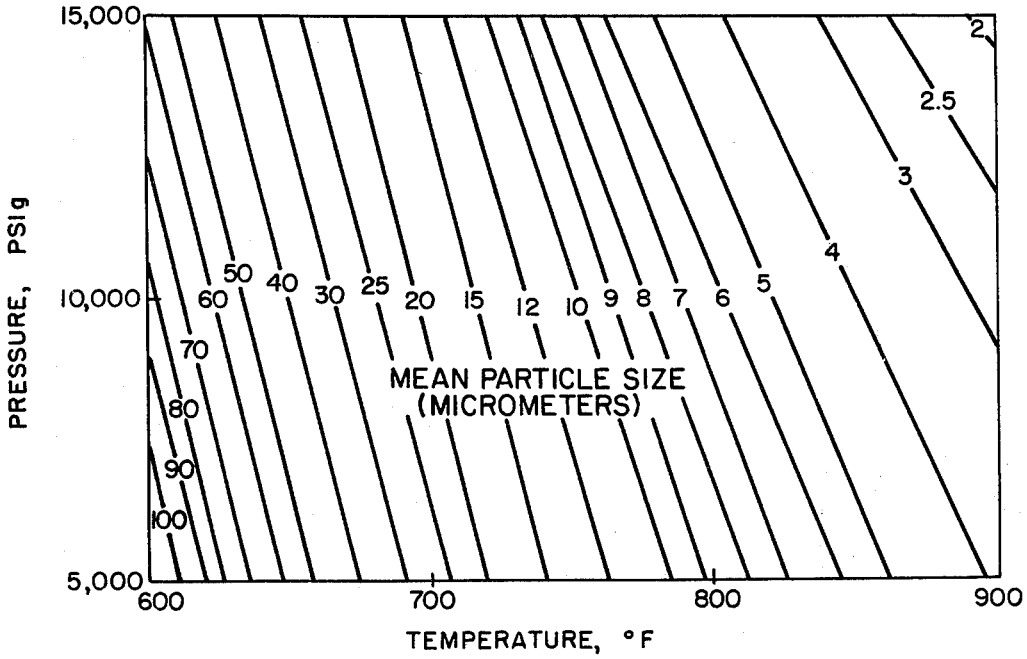
FIG. 2 is a graph showing the volumetric mean particle size of the explosively shattered product of Illinois-6 coal as a function of temperature and pressure.

General Description of the Preferred Process and Apparatus Used Therein

Referring to a preferred embodiment of the process of the present invention, as illustrated in block diagram form in FIG. 1, a slurry of a liquid, such as water, and a solid hydrocarbonaceous material, such as coal is prepared in a mixing and storage unit 12. The hydrocarbonaceous solid is preferably coal, but could also be oil shale or any other porous or fluid-permeable, friable hydrocarbonaceous solid containing an admixture of hydrocarbonaceous particles and mineral particles. The quantity of water added to unit 12 is an amount sufficient to fill the pores and cavities of the coal, preferably by first forming a true slurry, i.e. enough liquid to fill the pores of the solid and the intersititial spaces between the solid particles, producing a mixture having fluid characteristics for ease in handling.

An electrolyte is preferably added to the slurry by control unit 13. The electrolyte is preferably a solution of hydroxide salts having a basic pH, such as sodium hydroxide, calcium hydroxide or ammonium hydroxide. The electrolyte provides a method of controlling the temperature of the reactor and to increase the temperature operating range.

In addition to temperature control, the electrolyte addition also aids in avoiding coal agglomerating at high temperatures. It is known that coals have a strong tendency to agglomerate at temperatures above their softening point. It has recently been reported that the melting point of coal can be raised by contact with calcium hydroxide due to an undefined reaction between the coal and the calcium ion. Feldman et al, *Summary Report on A Novel Approach to Coal Gasification Using Chemically Incorporated CaO,* Nov. 11, 1977 (Battelle Memorial Institute, Columbus, Ohio). In contrast, we believe that the reaction which is involved takes place between the hydroxide ion and the substances known as macerals, which melt and become sticky as the coal is heated above its softening point. In any event, we have discovered that by increasing the pH of the slurry, such as by adding basic hydroxide ion, the slurry can be heated somewhat beyond the normal melting point of the coal without agglomerating of the coal particles.

As indicated in FIG. 1, the slurry is passed, as needed, to a feed system 14 which preferably delivers the feed at a constant pressure equal to the desired operating pressure of the heating zone. By delivering the slurry at a constant pressure, the feed pumping system 14 counteracts or compensates for pressure changes within the process. The rate at which slurry is delivered decreases as the pressure increases and vice versa. Pressurization in combination with the high temperature forces the water into the pores of the normally hydrophobic coal. The desired pressure is greater than the critical pressure of the liquid which is used to make the slurry, i.e. for water about 3200 psia, and less than about 16,000 psia, preferably between about 4,000 and about 16,000 psia. The upper limit of the reactor operating pressure is determined principally by the temperature and pressure rated capacity of the apparatus components.

The pressurized slurry is then delivered to a heating chamber 16 wherein the temperature of the slurry is raised to a predetermined temperature above the critical temperature of the liquid which in the case of water is about 705° F., and preferably below about 1000° F. Particularly preferred temperatures are between about 750° F. and about 950° F. The supercritical temperatures and pressures produce a supercritical fluid which penetrates and thus saturates the coal pores with a high energy compressed fluid.

Although many methods may be used to heat the slurry, heating chamber 16 preferably comprises an electrode positioned within a chamber adapted to operate at high temperatures and pressures. As slurry is passed through the chamber, an electrical current is passed from the electrode through the slurry to the chamber wall. The resistance of the slurry is thus used as a method of directly heating the slurry passed to heating chamber 16.

The temperature at which coal begins to agglomerate varies between about 650° and about 825° F. and is a function of the type of coal being heated. As stated, this agglomeration can be reduced to some degree by the addition of hydroxide ion. In addition, agglomeration in heating chamber 16 can be minimized or avoided, without adding hydroxide, by using a slurry with low solids content, preferably less than about 15 to 25 by weight percent solids.

The pressurized, heated slurry is held in a chamber 18 for a predetermined length of time sufficient to insure penetration and saturation of the supercritical water into the pores and interstices of the coal. The optimum residence time is dependent on the temperature and pressure as well as the size of the coal particles, and the type of coal used in making the slurry. Preferred residence times are less than 15 seconds in the preferred pressure and temperature range. It has been discovered that increasing the residence time up to about 15 seconds increases the degree of comminution up to a certain point, and that increasing the residence time beyond 15 seconds has no added or improved effect. In fact, long residence times are to be generally avoided because they may lead to undesired solvation of the coal, reduced shattering, and dissolution of the minerals in the coal and/or cause undesired chemical reactions.

The heated and pressurized slurry is then passed to an expansion unit 20 wherein the high pressure imposed on the slurry is reduced rapidly, preferably in a substantially instantaneous fashion. The pressure to which the slurry is reduced is below the critical pressure of the liquid and is preferably about ambient pressure, i.e. about 75 psia or lower. The temperature of the slurry drops as a result of the adiabatic expansion of the fluid in the slurry. Preferably, however, the temperature drop is controlled to provide a temperature above the dew point of the water at the second pressure to prevent vapor condensation which can interfere with subsequent separation steps. Particularly preferred final temperatures after expansion are about 250° F.

The expansion unit preferably includes a high pressure adiabatic expansion orifice having a small opening sufficient to permit the coal particles to pass without plugging. The design of the orifice includes an opening which provides for passage of the slurry across the opening in less than about 10 microseconds, preferably in less than about 1 microsecond. The design of this orifice insures that the reduction in the pressure imposed on the coal will occur substantially instantaneously, preferably in less than 100 microseconds. Particularly preferred times for this pressure reduction are less than about 10 microseconds and most particularly preferred are less than about 1 microsecond.

The time required for the slurry to pass from supercritical pressures to the lower preferably ambient pressure is as short as possible so that the high pressure of fluid in the pores is prevented from being gradually released or "leaking" from the pores. The more rapid the depressurization, the more the coal is comminuted since the potential energy of fluid expansion contained in the pores of the coal is not prematurely lost.

It has also been discovered that if the coal impinges on an obstruction near the orifice opening, the selectivity of the comminution process is reduced because this impingement causes comminution of the mineral matter as well as the hydrocarbonaceous material in the coal. In this connection, it has been discovered that the material discharged from the orifice at supercritical temperatures and pressures emerges from the opening in a hemispherical pattern, expanding in all directions up to 135 degrees from the direction of flow through the opening. In order to prevent any of the emerging material from impinging against the face of the orifice, the end wall or face of the orifice is preferably disposed in relation to the direction of flow through the opening so as to form an angle of about 90 degrees to about 135 degrees.

The shattered or comminuted product is preferably produced as a suspension of micron sized solid particles in vapor, i.e. steam in the case of water. This product may then be passed to various recovery units for fractionation of the mineral particles from the hydrocarbonaceous particles as well as fractionating the hydrocarbonaceous particles from the vapor. For example, a cyclone can be used to fractionate the mineral fraction of the shattered coal from the hydrocarbonaceous fraction. The comminuted hydrocarbonaceous particles can be subsequently recovered using a condenser and dryer. Alternatively, the vapor phase suspension may be passed directly to a burner for combustion by contact with oxygen at high temperatures.

General Description of the Principal Operating Parameters Encountered in The Preferred Embodiment of The Present Invention Coals are commonly ranked as anthracite, bituminous, sub-bituminous, lignite or peat. Even within these classifications coals exhibit varying characteristics in relation to the geographical region or seam from which they are mined. Though it is possible to have some variation in coal seams even on a local scale, uniformity is generally evident on a regional scale. Thus, bituminous Illinois-6 coal differs appreciably from bituminous Pittsburgh-8 coal in many respects.

The characteristics of the product of the comminution process vary somewhat with the characteristics of the feed coal. For example, a bituminous coal, Illinois-6, was comminuted to a mean volumetric particle size of 3.09 microns by operating at 9200 psia and 760° F. A bituminous coal, Pittsburgh-8, was comminuted to a volumetric mean particle size of 2.96 microns by operation at 6600 psia and 800° F.

The examples and experiments described herein are representative of the results obtained for the listed types of coal. However, it is noted that in order to obtain optimum results for any particular coal supply, a certain amount of empirical studies should be made.

The more significant operating variables of the process of the invention include temperature, pressure and residence time of the slurry at supercritical conditions, together with choice of soluble additives. Various pressures and temperatures ranging from subcritical up to 1000° F. and 16,000 psia have been investigated. As indicated earlier, the mean particle size of the comminuted product is significantly reduced as the temperature and pressure of the slurry are increased from the subcritical into the supercritical range of the water.

For example, the following table illustrates the differences obtained by conducting a continuous explosive comminution operation at subcritical conditions versus supercritical conditions utilizing the apparatus and methods described in co-pending application of Massey et al filed herewith, Ser. No. 127,736, entitled "Method and Apparatus for Heating Liquids and Agglomerating Slurries", the teachings of which are incorporated by reference herein. In each instance, the coal was an Illinois-6 coal having an initial particle size range of about 5 to 150 microns and a mean particle size of about 75 microns. In each run, the feed coal was mixed with sufficient water to provide a slurry containing about 20 wt% coal.

TABLE 1

SIZE DISTRIBUTION OF EXPLOSIVELY SHATTERED AT SUB- AND SUPERCRITICAL TEMPERATURE CONDITIONS

| Particle Size Range (Microns) | Conditions | | | |
|---|---|---|---|---|
| | 660° F. 8600 psig | 700° F. 5400 psig | 830° F. 12400 psig | 860° F. 10000 psig |
| 125–178 | 3.9 vol. % | 0.0 vol. % | 0.0 vol. % | 0.0 vol. % |
| 88–124.9 | 18.1 | 4.5 | 0.6 | 0.0 |
| 62–87.9 | 17.2 | 11.5 | 0.0 | 0.0 |
| 44–61.9 | 16.0 | 12.7 | 0.0 | 15.4 |
| 31–43.9 | 11.9 | 10.2 | 0.0 | 0.0 |
| 22–30.9 | 9.0 | 13.7 | 0.0 | 0.0 |
| 16–21.9 | 6.8 | 13.6 | 0.0 | 0.0 |
| 11–15.9 | 3.8 | 9.7 | 0.6 | 0.0 |
| 7.8–10.9 | 4.6 | 7.0 | 7.6 | 0.0 |
| 5.5–7.7 | 1.9 | 5.6 | 16.3 | 6.8 |
| 3.9–5.4 | 2.5 | 4.7 | 17.1 | 11.4 |
| 2.8–3.8 | 2.4 | 3.1 | 15.5 | 15.4 |
| 1.9–2.7 | 0.8 | 2.0 | 27.9 | 33.8 |
| 1.4–1.8 | 0.4 | 1.0 | 13.9 | 16.9 |
| Volumetric Mean Particle size, Microns | 49.2 | 23.6 | 2.71 | 3.27 |

The results show that the volumetric mean particle size of the product produced by comminution at supercritical conditions are about an order of magnitude smaller than the volumetric mean particle size obtained by comminution at subcritical conditions. In addition, supercritical conditions provide a product wherein a substantial portion of the product has a particle size of less than about 5 microns whereas operation at subcritical conditions provides a product with only a small fraction of its particles reduced to this size range.

It has been found that by operating at subcritical conditions, the mean product particle size initially decreases linearly with respect to increasing pressure until the pressure reaches about 7,000 psia. Increasing the pressure beyond this level produces a continued decrease in particle size. The decrease, however, is not as appreciable in response to increased temperature in this range as it is in the lower pressure range. The effect of temperature on the product mean particle size is somewhat more complex than that of pressure. The mean particle size of the product initially decreases with respect to increasing temperatures up to an optimum value for the coal in the slurry. Increasing the temperature beyond that point, however, while maintaining a constant pressure, increases the mean particle size of the product.

Other variables in operation of the invention include the identity and/or properties of the feed coal, the amount of coal in the slurry, the raw feed particle size, the size of the orifice passage or opening, and the length of time required for the slurry to pass across the opening. Preferred slurries for use in the present invention have solids contents between about 10% and about 60% by weight. The degree of comminution obtained, however, is substantially independent of solids content. The upper limit on solids content of the slurry is determined principally by the ability to pump or otherwise handle a high solids content slurry and to avoid agglomeration at the high temperatures employed in the present invention, i.e. solids handling and agglomeration problems increase as the percent solids in the slurry increases. It is preferable, however, to use as high a solids content as possible to avoid wasting energy by heating and pressuring unnecessary amounts of water.

As used herein, the percent solids in the coal slurry is defined as follows:

$$\left(\frac{\text{grams Dry Coal}}{\text{grams Dry Coal + Liquid}}\right) \times 100 = \%\ \text{Solids in slurry}$$

This calculation requires the coal to be dried to a constant weight basis at a temperature of 110° C. to make this determination. In actual practice, however, the coal is not dried before the slurry is formed. Rather, the slurry is formed from a coal on an "as-received" basis and the solids content is then determined by filtering a weighed amount of the slurry, and drying the resultant filter cake.

As indicated, the amount of solids in the slurry does not materially effect the size distribution of the final product. It is again emphasized, however, for purposes of economics, to use as high a solids content as can be reasonably pumped and heated.

In general, the maximum solids content that can be pumped by known pumping equipment is an aqueous slurry containing about 50–60% by weight coal. Coarser coal particles in the slurry permit higher solids contents; finer coal particles in the slurry require lower solids contents.

In addition, as detailed in co-pending application, filed herewith, Ser. No. 127,736, entitled "Method and Apparatus For Heating Liquids and Slurries", Massey et al, inventors, the disclosure of which is incorporated by reference, the percent solids in feed can have some effect on the heating characteristics of the slurry relative to fouling of the heating operations. In general, higher solids contents produce higher fouling rates of the heating operations.

As the feed particles increase in size, the necessary residence time will increase. In any event, the size of the feed particles must be smaller than the orifice opening to avoid plugging the orifice. The preferred size of the orifice opening is at least three times as large as the size of the largest feed particles. The size of the feed particles dictates pressure, temperature and residence time for each type of coal, and is best determined empirically. The size of the solids particles may thus be increased as the size of the orifice opening is increased.

The length of time desired for the slurry to cross the opening determines the length of the opening. That is, the length of the opening must be designed so that, considering the velocity of slurry through the opening, the time in crossing the opening will be less than a predetermined maximum. As explained previously, it has been discovered that this length of time should be as small as possible so that the supercritical field is not permitted to escape from the pores of the solid in the orifice, as opposed to instantaneously escaping in the explosion zone to disrupt the solid in less than about 10 microseconds and preferably less than about 1 microsecond.

Experimental results have been correlated to show the effect of temperature, pressure and residence time on the shattered product particle size. It is useful for present purposes to combine the effects of temperature and pressure into a single variable referred to as the net enthalpy of the water. This variable is defined as follows:

$$\text{Net Enthalpy (NE)} = \left[\text{enthalpy of water at operating temperature and pressure} - \text{Enthalpy of Water at 212° F. and 1 atm.}\right] \times \text{Fraction of Water that will be Converted to Steam}$$

NE is expressed as "BTU/in$^3$".

An empirical equation has been obtained to calculate the net enthalpy in the temperature and pressure ranges of importance. The equation in terms of temperature, pressure and square of temperature is:

$$NE = 8.172(T) + 0.15022(P) - 0.38469(T^2) - 29.664$$

where:

NE is expressed as BTU/in$^3$.

$T$ = temperature in °F. $\times 10^{-2}$.

$P$ = pressure in psia $\times 10^{-3}$.

This equation has a correlation coefficient of 0.995 where:

$5{,}000 < P < 15{,}000$ psia $700 < T < 900$° F.; and $P \div [(42.5T) - 27200] < 1$.

The preferred residence time at these conditions is about 5 seconds.

The correlation of these higher temperatures and pressures on the mean product particle size of Illinois-6 coal (including its unaffected mineral matter), assuming residence time of about 5 seconds, is expressed by the following equation:

$$\log \mu = 7.7575 - 0.4742(NE)$$

Where $\mu$ = volumetric mean particle size in microns and net enthalpy (NE) is expressed in BTU/in$^3$ of water. Temperatures between about 800° and about 950° F. and pressures between about 7,000 and 12,000 psia consistently yielded a shattered product having a mean particle size ranging between 2.5 and 6 microns. FIG. 2 illustrates the mean particle size in microns of the shattered product of Illinois-6 feed coal as a function of the temperature and pressure conditions in the process of the invention.

The effect of high temperature and pressure on the shattering of Illinois-6 coal indicates the existence of an inverse linear relationship between the log mean volumetric particle size of the shattered product and the net enthalpy of the slurry in the shattering unit. Thus, the logarithm of the volumetric mean particle size decreases linearly in relation to increases of the net enthalpy in the comminution system.

A parametric study similar to the one with Illinois-6 coal explained above was conducted for Pittsburgh-8 coal. Correlation was obtained for mean particle size of the shattered product as a function of net enthalpy and log of net enthalpy. The equation may be expressed as follows:

$$\mu = 374.8 + 17.19(NE) - 231.38 \ln (NE)$$

where:

$\mu$ = volumetric mean particle size in microns

NE = net enthalpy in BTU/in$^3$.

Figure 3:
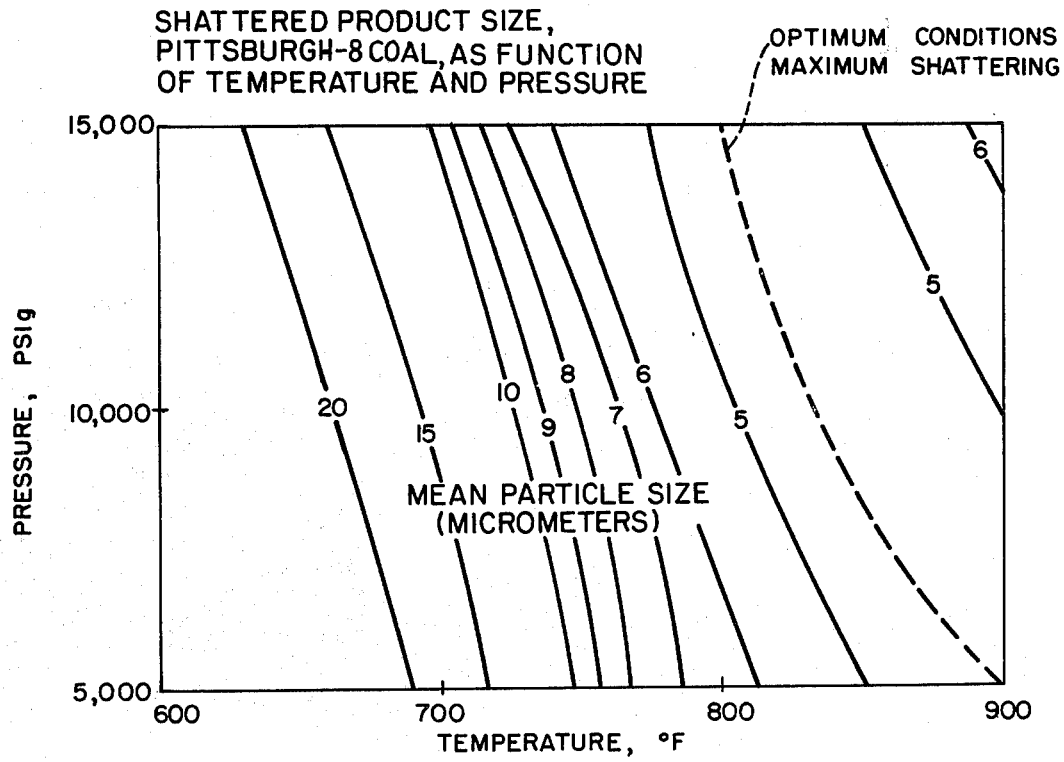
FIG. 3 is a graph of the volumetric mean particle size of explosively shattered Pittsburgh coal as a function of temperature and pressure.

FIG. 3 shows the volumetric mean particle size in microns of the shattered product Pittsburgh-8 coal and its mineral content as a function of temperature and pressure conditions in the process of the invention.

An investigation of the effect of the size of the feed coal on the size of the shattered product included feed coal with maximum particle sizes ranging from about 50 microns to about 240 microns. All feed sizes produced substantially similar, successful shattering results. Accordingly, it is possible to further increase the maximum shatterable feed size by the installation of orifices with larger diameter since our results indicate that mean particle size of the shattered product is substantially independent of feed size.

Description of the Comminuted Product

The product resulting from the explosive comminution of coal according to this invention has been tested by a variety of physical and physiochemical analyses. These analyses show that the feed coal can be comminuted and then separated into two distinct components or fractions. One of the fractions, a hydrocarbonaceous fraction, consists substantially of hydrocarbonaceous particles which have comminuted to a very fine particle size, i.e. less than 5 microns in diameter. This hydrocarbonaceous fraction has a lower density, a higher solubility and a different rate of oxidation in ambient atmosphere than the original feed stock. Moreover, this hydrocarbon fraction includes a subfraction of particles having a mean particle size of less than two microns in diameter. These particles consist essentially of hydrocarbons and are characterized by the substantially complete absence of ash forming minerals or sulfur of any form.

An analysis according to ASTM designated procedures (1977 Annual Book of ASTM Standards, Part 26) of raw feed coals and the resultant explosively shattered products were performed and the results are listed in Table II below. The explosively comminuted products were collected by quenching with water. The product analysis applies to the resultant filtered and water-washed product solids with no removal of mineral matter.

TABLE II

PROXIMATE AND ULTIMATE ANALYSIS OF FEED AND EXPLOSIVELY SHATTERED PRODUCT

| | | Illinois-6 | | | | Pittsburgh-8 | | | |
|---|---|---|---|---|---|---|---|---|---|
| | | FEED | | PRODUCT | | FEED | | PRODUCT | |
| PROXIMATE ANALYSIS, WT% | | | | | | | | | |
| % Volatile | | 36.85 | | 32.27 | | 31.49 | | 30.59 | |
| Btu/lb | | 11,206 | | 11,504 | | 13,449 | | 13,140 | |
| % Fixed Carbon | | 44.07 | | 48.53 | | 57.71 | | 58.89 | |
| ULTIMATE ANALYSIS, WT% | | | | | | | | | |
| Carbon | | 63.22 | | 64.98 | | 74.67 | | 73.90 | |
| Hydrogen | | 4.49 | | 4.13 | | 4.76 | | 4.77 | |
| Nitrogen | | 1.19 | | 1.02 | | 1.27 | | 1.46 | |
| Chlorine | | 0.20 | | 0.03 | | 0.05 | | 0.03 | |
| Sulfur: Sulfate | | 0.19 | | 0.03 | | 0.00 | | 0.00 | |
| Sulfur: Pyritic | 4.79 | 2.25 | 3.80 | 1.57 | 2.25 | 1.27 | 2.15 | 1.00 | |
| Sulfur: Organic | | 2.35 | | 2.20 | | 0.98 | | 1.15 | |
| Ash | | 19.08 | | 19.10 | | 10.80 | | 10.52 | |
| Oxygen (Diff.) | | 7.03 | | 6.94 | | 6.20 | | 7.17 | |
| | TOTAL | 100.00 | | 100.00 | | 100.00 | | 100.00 | |
| ASH ANALYSIS, WT% | | | | | | | | | |
| $SiO_2$ | | 50.83 | | 53.89 | | 55.65 | | 52.64 | |
| $Al_2O_3$ | | 19.19 | | 19.11 | | 23.86 | | 23.18 | |
| $TiO_2$ | | 0.81 | | 0.92 | | 1.10 | | 1.10 | |
| $Fe_2O_3$ | | 16.64 | | 17.66 | | 14.01 | | 17.96 | |
| CaO | | 4.80 | | 3.95 | | 0.70 | | 0.97 | |
| MgO | | 1.05 | | 1.05 | | 0.66 | | 0.75 | |
| $K_2O$ | | 1.87 | | 1.85 | | 1.70 | | 1.50 | |
| $Na_2O$ | | 1.25 | | 0.40 | | 0.43 | | 0.42 | |
| $SO_3$ | | 3.16 | | 0.99 | | 0.65 | | 0.91 | |
| $P_2O_5$ | | 0.15 | | 0.15 | | 0.31 | | 0.25 | |
| Undetermined | | 0.25 | | 0.03 | | 0.93 | | 0.32 | |
| | TOTAL | 100.00 | | 100.00 | | 100.00 | | 100.00 | |

These results show that the overall composition of the coal is not significantly altered within the range of experimental error by the practice of the present invention. Yet, as the following experiments show, the hydrocarbonaceous fraction of the product coal is a substantially different substance than the original coal.

I. Mean Product Particle Size

In the data discussed below, the size distribution analysis of the product coal particles was accomplished with a laser beam scattering technique using a MICROTRAC particle size analyzer manufactured by the Leeds/Northrup Co., Inc. The MICROTRAC unit operates by measuring the scattering of light from a laser beam in a defined field and calculating the volume of each counted particle within that defined field, assuming all particles to be spherical. The particles are sorted into a predermined range of volume sizes and the percentrage of total particles within each volume size range is determined. The results are converted to mean particle diameters and listed as a percentage of particles having a volumetric mean particle diameter within a defined mean particle diameter range.

The volume distribution method of calculating mean particle size is a method of statistically weighting the reported mean particle diameter to avoid favoring the more numerous, smaller particles and to approximate the size distribution on a weight basis. For example, when a comminuted product is analysed first by the direct count method and then by the volume distribution method, as reported in Table III, the direct count method reports a smaller mean particle size than is reported by the volume distribution used therein.

TABLE III

COMPARISON OF REPORTED RESULTS
Volume Distribution Basis vs. Direct Count Basis

| Particle Diameter Range (Microns) | Direct Count of Product Particles Within Range (%) | Volume of Particles Within Range (%) | Accumulated particle count, (%) [1] | Accumulated Volume, (%) [2] |
|---|---|---|---|---|
| 178-125 | 0.0 | 0.0 | 100.0 | 100.0 |
| 125-88 | 0.0005 | 3.4 | 99.999 | 96.6 |
| 88-62 | 0.0021 | 4.9 | 99.997 | 91.7 |
| 62-44 | 0.0151 | 12.3 | 99.98 | 79.4 |
| 44-31 | 0.0490 | 14.1 | 99.93 | 65.3 |
| 31-22 | 0.1267 | 12.9 | 99.81 | 52.4 |
| 22-16 | 0.4284 | 16.3 | 99.38 | 36.1 |
| 16-11 | 0.8611 | 11.6 | 98.52 | 24.5 |
| 11-7.8 | 1.8672 | 8.6 | 96.65 | 15.9 |
| 7.8-5.5 | 3.6884 | 5.8 | 92.96 | 10.1 |
| 5.5-3.9 | 7.5353 | 4.2 | 85.43 | 5.9 |
| 3.9-2.8 | 14.0921 | 2.9 | 72.33 | 3.0 |
| 2.8-1.9 | 28.7044 | 2.0 | 42.63 | 1.0 |
| 1.9-1.4 | 42.6297 | 1.0 | 0.00 | 0.0 |

Mean Particle Size
By Direct Count: 2.13 microns
By Volume Distribution: 20.8 microns

[1] Accumulated number of product particles within or smaller than range (%).
[2] Accumulated volume of particles within or smaller than range (%).

In Table III, the product analyzed by the direct count reported a mean particle size of about 2.13 microns, but the same product analyzed by the volume distribution reported a mean particle size of 20.8 microns. Inportantly, although about 40% of the product particles are smaller than 2 microns, reported on a direct count basis, that 40% represents only about 1% of the mass of shattered product.

The size distribution bias, which occurs with the direct count basis, is substantially avoided when the results are reported on a volume distribution. This distinction must be appreciated when comparing the results herein with those of the prior art: a product reported herein with a volumetric mean particle diameter of about 5 microns is substantially smaller than a product reported as having a mean particle diameter of 5 microns calculated on the direct count basis, as illustrated in columns 2 and 3 of Table III.

SPECIFIC EXAMPLES

The advantages of the preferred embodiment of the present invention are illustrated by reference to the following examples.

EXAMPLE I

Raw Illinois-6 coal containing 20% by weight mineral matter was pulverized by grinding the coal, passing the resultant ground coal through a 100 mesh screen, recovering the smaller than 100 mesh fraction and recycling the larger fraction back to the grinding operation. The pulverized raw coal was mixed with water to prepare a slurry of about ten (10) percent solids by weight. The slurry was pressurized and heated to supercritical conditions using methods previously described. The slurry was maintained at about 11,400 psia and about 810° F. for at least 5 seconds after which the slurry was then passed through an adiabatic expansion orifice into an expansion zone maintained at a temperature of 212° F. and pressure of 14.5 psia within about 0.3 microsecond. The size distribution of the feed and of the resultant shattered product with all minerals present and essentially unchanged in size are listed in Table IV.

TABLE IV

SIZE DISTRIBUTION OF FEED AND EXPLOSIVELY SHATTERED PRODUCT OF ILLINOIS-6 COAL

| Particle Size Range (Microns) | Volume Percent Feed | Volume Percent Total Product | Hydrocarbonaceous Portion of Product |
|---|---|---|---|
| 125-178 | 12.9 | 2.3 | 2.4 |
| 88-124.9 | 20.7 | 1.1 | 1.3 |
| 62-87.9 | 18.6 | 0.0 | 0.0 |
| 44-61.9 | 19.7 | 0.0 | 0.0 |
| 31-43.9 | 7.0 | 0.0 | 0.0 |
| 22-30.9 | 3.7 | 0.0 | 0.0 |
| 16-21.9 | 6.1 | 0.0 | 0.0 |
| 11-15.9 | 1.3 | 6.0 | 0.0 |
| 7.8-10.9 | 1.3 | 6.0 | 4.0 |
| 5.5-7.7 | 0.9 | 14.8 | 14.4 |
| 3.9-5.4 | 2.0 | 15.7 | 15.1 |
| 2.8-3.8 | 1.9 | 15.0 | 14.7 |
| 1.9-2.7 | 0.1 | 29.8 | 32.1 |
| 1.4-1.8 | 0.0 | 14.9 | 16.0 |
| Mean Particle Size (Microns) | 64.9 | 3.09 [a] | 2.84 |

[a] Includes mineral particles with unchanged particle size distribution.

Next, samples of the product and raw feed coal were subjected to a low-temperature ashing using activated oxygen plasma. This removed all hydrocarbon from the mineral component, which was left substantially in its natural state and analyzed for size distrubtion. The results are set forth in Table V.

TABLE V

MINERAL PARTICLE SIZE DISTRIBUTION IN FEED AND EXPLOSIVELY SHATTERED PRODUCT OF ILLINOIS-6 COAL

| Particle Size Range (Microns) | Volume Percent Feed | Volume Percent Product |
|---|---|---|
| 125-178 | 0.0 | 0.5 |
| 88-124.9 | 0.8 | 0.2 |
| 62-87.9 | 3.2 | 0.0 |
| 44-61.9 | 6.5 | 3.6 |
| 31-43.9 | 2.9 | 5.1 |
| 22-30.9 | 5.0 | 7.4 |
| 16-21.9 | 9.2 | 8.4 |
| 11-15.9 | 10.7 | 11.2 |
| 7.8-10.9 | 15.2 | 12.6 |
| 5.5-7.7 | 13.9 | 11.7 |
| 3.9-5.4 | 12.8 | 13.0 |
| 2.8-3.8 | 8.2 | 11.0 |
| 1.9-2.7 | 6.7 | 9.7 |

TABLE V-continued

MINERAL PARTICLE SIZE DISTRIBUTION IN FEED AND EXPLOSIVELY SHATTERED PRODUCT OF ILLINOIS-6 COAL

| Particle Size Range (Microns) | Volume Percent Feed | Volume Percent Product |
|---|---|---|
| 1.4–1.8 | 3.3 | 4.8 |
| Mean Particle Size (Microns) | 8.48 | 7.36 |

The results show that the mean particle size of the minerals contained in the feed coal remains substantially unaffected by the explosive comminution process whereas the particle size of the feed, as a whole, is greatly reduced by the shattering operation. In other words, substantially all of the explosive shattering force results in reducing the mean particle size of the hydrocarbon in the feed coal and not of the undesired ash forming or mineral portion of the coal. Moreover, since the minerals exhibit a larger particle size, many of the particles of the final product in the larger size range can be attributed to the minerals and that the mean particle size of the hydrocarbon in the overall product as indicated is less than the mean particle size observed for the product overall.

EXAMPLE II

Example I was repeated using a Pittsburgh-8 coal containing 10 percent mineral matter. The effect of the explosive comminution reaction on the mean particle size of the feed and of the mineral component of the feed are set forth below in Tables VI and VII, respectively.

TABLE VI

SIZE DISTRIBUTION OF FEED AND EXPLOSIVELY SHATTERED PRODUCT OF PITTSBURGH-8 COAL

| Particle Size Range (Microns) | Volume Percent Feed | Volume Percent Total Product | Hydrocarbonaceous Portion of Product |
|---|---|---|---|
| 125–178 | 8.0 | 0.0 | 0.0 |
| 88–124.9 | 11.9 | 0.0 | 0.0 |
| 62–87.9 | 28.5 | 0.0 | 0.0 |
| 44–61.9 | 19.9 | 2.6 | 3.0 |
| 31–43.9 | 7.7 | 1.6 | 1.8 |
| 22–30.9 | 7.4 | 0.0 | 0.0 |
| 16–21.9 | 4.4 | 0.0 | 0.0 |
| 11–15.9 | 6.2 | 5.5 | 5.3 |
| 7.8–10.9 | 3.0 | 3.4 | 2.3 |
| 5.5–7.7 | 0.0 | 3.4 | 1.0 |
| 3.9–5.4 | 1.0 | 20.9 | 22.0 |
| 2.8–3.8 | 1.5 | 21.2 | 22.7 |
| 1.9–2.7 | 0.0 | 25.4 | 27.3 |
| 1.4–1.8 | 0.0 | 12.7 | 13.7 |
| Mean Particle Size (Microns) | 60.50 | 3.32[a] | 3.02 |

[a]Includes mineral particles with unchanged particle size distribution.

TABLE VII

MINERAL PARTICLE SIZE DISTRIBUTION IN FEED AND EXPLOSIVELY SHATTERED PRODUCT OF PITTSBURGH-8 COAL

| Particle size Range (Microns) | Volume Percent Feed | Volume Percent Product |
|---|---|---|
| 125–178 | 0.0 | 0.0 |
| 88–124.9 | 2.5 | 0.0 |
| 62–87.9 | 1.2 | 0.0 |
| 44–61.9 | 0.3 | 0.0 |
| 31–43.9 | 1.4 | 0.0 |
| 22–30.9 | 0.7 | 1.2 |
| 16–21.9 | 5.1 | 3.8 |
| 11–15.9 | 9.1 | 9.0 |
| 7.8–10.9 | 14.0 | 14.1 |

TABLE VII-continued

MINERAL PARTICLE SIZE DISTRIBUTION IN FEED AND EXPLOSIVELY SHATTERED PRODUCT OF PITTSBURGH-8 COAL

| Particle size Range (Microns) | Volume Percent Feed | Volume Percent Product |
|---|---|---|
| 5.5–7.7 | 15.4 | 17.0 |
| 3.9–5.4 | 15.8 | 17.3 |
| 2.8–3.8 | 12.9 | 13.8 |
| 1.9–2.7 | 13.9 | 15.6 |
| 1.4–1.8 | 6.9 | 7.8 |
| Mean Particle Size | 5.50 | 4.98 |

These results closely parallel the results previously observed for Illinois-6 coal and show that explosive comminution technique, as taught by this invention, results in a great selectivity of comminution. Whereas the total feed coal is reduced from a mean particle size of about 60 microns to about 3 microns, the mineral content is substantially unaffected, its mean particle size being reduced by only about 1 micron or less.

II. Density of Product

The density[1] of the feed coal is greatly changed through utilization of the method of this invention. A typical raw feed coal has a density of approximately 1.3 to 1.4 g/cc. The hydrocarbon fraction of the shattered product produced in accordance with this invention, by way of contrast, is about 50% to 75% of the density of the feed coal, specifically an apparent density of about 0.7 to about 0.9 g/cc. This difference cannot be accounted for by mineral constituents. No known raw coal or presently identified hydrocarbon fraction of raw coal has a density as low as that of the hydrocarbon fraction of the explosively shattered product obtained by the present invention. The low density of the hydrocarbon fraction makes this substance particularly useful for producing stable suspensions of the shattered coal in petroleum fuels and as a result may be used to extend this fuel.

[1]As used herein, density refers to the apparent density of the individual particles.

The manner in which the invention changes the density of the coal hydrocarbon fraction is not fully understood. It seems likely that the invention has resulted in expansion of the pores of the hydrocarbon, and an increase in the amount of gases entrapped within the coal. Gaseous displacement tests have shown that relatively large amounts of carbon dioxide are trapped within the hydrocarbon fraction. These tests involve passing a stream of oxygen or nitrogen through a slurry of the hydrocarbon fraction and collecting and analysing the gas stripped from the slurry. The tests show that either oxygen or nitrogen displaces about the same but significant quantity of carbon dioxide. It is possible that carbon dioxide is formed by chemical interaction of coal and water during the explosive shattering operation and the $CO_2$ is trapped within the pores of the hydrocarbon fraction.

The density of the various minerals, by way of contrast, lies from about 2 to about 5 g/cc. This density is substantially unchanged by the explosive comminution process. Since the minerals are from about 3 to about 7 times more dense than the fine coal and since the hydrocarbonaceous fraction has smaller mean particle size than that of the minerals, the hydrocarbonaceous fraction can be separated from the minerals by gravitational methods and apparatus well known to those trained in the art such as a cyclone. For example, a cyclone can separate a hydrocarbon fraction having a particle size of about 5 microns in diameter from ash and minerals having a particle size of about 3 microns in diameter because of the respective differences in mass.

III. Solubility of Product

Solubility tests show a further change in the product brought about by the process of the present invention. Raw feed coal is soluble in organic solvents to a slight extent, generally ranging from about 0.5 to about 5 percent depending upon the type of coal and solvent. It was not expected that the process of the present invention would significantly change the solubility of the shattered coal product. It was further discovered, however, that the solubility of the comminuted product is higher with respect to many known solvents than the solubility of the feed coals, ball-milled feed coal of comparable size or of any known form of coal.

In mechanical stirring solubility tests, a pre-weighed and dried sample of coal was placed in a beaker along with a measured volume of solvent (typically 250 ml). The beaker was then covered and the mixture stirred with a magnetic stirrer. The stirring was stopped the following day and the coal solubility determined by one of two methods. For the diluted mixtures, i.e., where the pre-weighed sample was less than about 5 grams, the mixture was simply filtered and the undissolved coal was dried and weighed. The weight of the dissolved coal was calculated by subtracting the weight of the undissolved coal from that of the original weight of coal. If the mixture was more concentrated, i.e., where the pre-weighed sample was more than about 25 grams, a large sample was removed and centrifuged. The clear solution was then decanted. After measuring its volume, the decanted solution was evaporated and the residual coal weighed. From the weight of this residual coal and the volume of the decanted solution, the solubility of the coal could be calculated.

The increase in solubility of the shattered product versus the feed coal has been shown in connection with solvents including carbon tetrachloride, gasoline, benzene, methanol and tetralin. The results are set forth in Table VIII below. As a control, solubilities were also determined for the raw feed coal and for the raw feed coal which had been ball milled to approximately the same particle size as the shattered product. The results indicate that the unexpected increase in solubility of the shattered product is not simply a function of size reduction or particle size. To the contrary, ball milling generally reduced the solubility of the coal.

TABLE VIII

SOLUBILITY OF EXPLOSIVE SHATTERED, BALL-MILLED ULTRAFINE AND FEED COALS IN VARIOUS ORGANIC SOLVENTS UNDER AMBIENT CONDITIONS

| | Fraction Soluble % | | | | |
|---|---|---|---|---|---|
| Sample | Gasoline | Benzene | Methanol | Carbon Tetra-Chloride | Tetra-lin |
| Explosively Shattered | | | | | |
| Pittsburgh-8 | 8.85 | 10.66 | 12.96 | 5.19 | 11.35 |
| Illinois-6 | 6.29 | 7.85 | 16.97 | 20.90 | 3.28 |
| Ball Milled | | | | | |
| Pittsburgh-8 | 0.48 | 2.30 | 2.09 | 0.97 | 0.87 |
| Illinois-6 | 0.37 | 1.55 | 2.65 | 0.44 | 0.98 |
| Feed | | | | | |
| Pittsburgh-8 | 1.50 | 1.92 | 2.67 | 4.88 | 1.82 |
| Illinois-6 | 0.85 | 3.08 | 1.70 | 3.85 | 2.53 |

A comparison of the results contained in Table VIII shows that the solubility of the shattered product is about 2 to about 6 times greater than the solubility of the feed coal and about 3 to about 18 times greater than the solubility of similarly sized feed coal prepared by ball milling.

The increase in solubility of the shattered product is further confirmed by experiments using methanol extracts of the shattered product, the feed coal, and feed coal ball milled to a particle size comparable to that of the shattered product. The results, shown in FIGS. 9 and 10 for Illinois-6 and Pittsburgh-8 coals, respectively, illustrate the absorbance of the extracts of various coals by methanol as against time. The samples were analyzed on a Water Model 244 ALC/GPC liquid chromatograph equipped with a Model 660 Solvent Programmer for gradient elution and a Schaeffel HS870 UV—visible detector Elution on a 4 mm×30 cmu bondpak C18 column was achieved by a methanol water gradient going from 60% methanol to 100% methanol in 20 minutes. The samples were monitored for aromatic components at 254 nm.

It is noted by way of interpretation of FIGS. 9 and 10, that the initial sharp peak at 1 minute is due to aromatics derived from the raw coal rather than the solubility of the solid hydrocarbon component. These aromatics have been removed from the shattered product during the shattering and recovery process and, thus, these peaks should be ignored for purposes of comparison. Second, the discontinued section in the graph of Illinois-6 coal (FIG. 9) occurs because the solubility of this coal exceeded the scale of the recorder. Third, solubilities of the different coals varies with different solvents. The solubility, for example, of Pittsburgh-8 coal in methanol is not as great as that of Illinois-6 coal. However, the results of both experiments confirm the earlier results of the mechanical stirring experiments.

The increase in solubility occurs to a significant degree only when operating at supercritical conditions, a fact which further confirms the importance of operating at supercritical conditions. For example, referring to Table I, the product comminuted at 700° F. and 5400 psia had a solubility in methanol of only 7.29% whereas the product of the same feed exploded at 830° F. and 12,400 psia has a solubility of 19.60%.

IV. Reactivity of Explosively Shattered Coal

Figure 7:
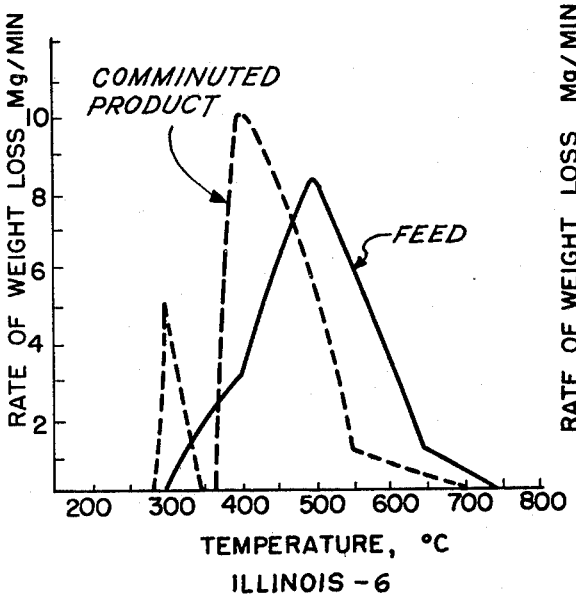
FIG. 7 is a graph comparing the decomposition rates of raw, feed Illinois-6 coal and the explosively shattered product produced in accordance with the present invention.
Figure 8:
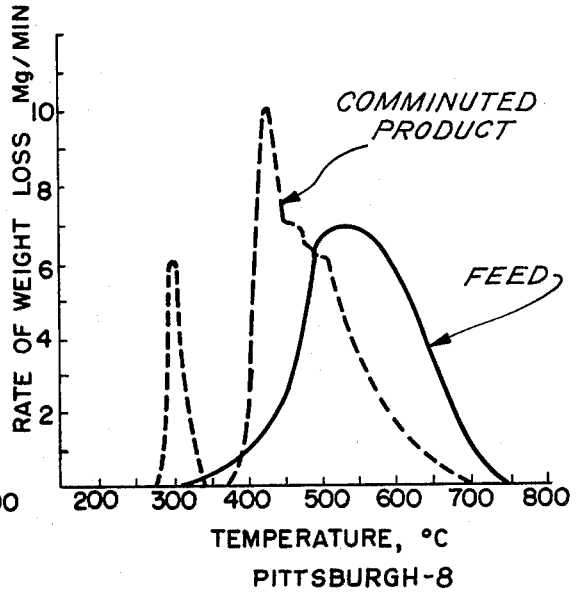
FIG. 8 is a graph comparing the decomposition rates of raw, feed Pittsburgh-8 coal and the explosively shattered product produced in accordance with the present invention.

The reactivity of the shattered product and of the feed coals was compared by evaluating their respective oxidation rates, determined using thermogravimetric analysis in air at a constant rate of heating of about 40° C./minute. The thermograms of the shattered product and of the feed coal using an Illinois-6 and a Pittsburgh-8 coals are shown in FIGS. 7 and 8, respectively.

The explosively shattered products of the Illinois-6 and of the Pittsburgh-8 coal show the presence of a low-temperature combustible constituent which starts reacting at about 280° C. and peaks at about 300° C. This low temperature combustible component is not present in known coal hydrocarbons. The low temperature peak of the shattered product is a true oxidation reaction rather than a volatilizing of components in the coal, as was shown by the fact that the peak is not present when the experiment was repeated in a nitrogen atmosphere. Thermograms of conventional coals exhibit a low-temperature peak at 100° C. which is attributable to the volatilization of water. Since the water and volatile materials are not present in the dried shattered product of this invention, the low temperature peak of conventional coal thermograms should not be considered for comparative purposes. Decomposition of the low temperature combustible component was recorded to be complete at about 350° C.

Peak oxidation temperature refers to the temperature at which the coal exhibits its highest rate of weight loss. The peak oxidation temperature of conventional coals generally increases with the rank of the coal. The shattered product sample had a lower peak oxidation temperature than that of the feed coals and of other comparably ranked known coal forms. For example, the peak oxidation temperature of the shattered product of bituminous coal, Illinois-6, is reduced to that of the more reactive sub-bituminous ranks of coal. The rate of oxidation, or rate of weight loss, of the shattered bituminous coal at lower temperatures is also as great or greater than that of the sub-bituminous coals, as shown by the FIGS. 7 and 8. However, the heating value of the shattered bituminous rank coals, remained relatively unchanged from the heating value of the feed coal. For example, the heating value of the Illinois-6 feed coal was 11,206 BTU/lb. and of the shattered product, 11,504 BTU/lb. The Pittsburgh-8 feed coal had a heating value of 13,449 BTU/lb. and the shattered product, 13,140 BTU/lb.

V. Fractionation of Product

As indicated earlier, the amount of mineral matter contained in coal varies with the source of the coal. In general, the process of the present invention is applicable for mineral removal from coals containing greater than about 5% by weight mineral matter although the process can be used for coal containing lesser amounts of mineral matter where economically feasible, and a finely divided product is desired. Particularly advantageous results are obtained with coals containing about 5–30 wt% mineral matter. Particularly preferred are coals containing about 7–25% mineral matter. In addition, the present invention can be utilized with coke and char materials containing up to about 40–60% by weight mineral matter.

According to a preferred embodiment of the present invention, porous hydrocarbonaceous materials such as coal are comminuted and then fractionated into at least one hydrocarbonaceous enriched fraction and at least one mineral enriched fraction. The exact degree of fractionation that can be obtained is, in general, dependent upon the source of the coal and the amount and particle size distribution of mineral matter contained in the coal. By use of the term "hydrocarbonaceous enriched fraction" is meant that more than about 50 wt% of the mineral matter originally present in the coal has been removed from the original material. Accordingly, the hydrocarbonaceous fraction contains less than about 50 wt% of the mineral matter originally present in the coal. Particularly preferred are hydrocarbonaceous fractions containing less than 75% of the mineral material originally present in the coal.

Similarly, the term "mineral enriched fraction" means that more than 50% of the mineral material originally present in the coal is contained in the mineral fraction. Preferably more than 75% of the mineral material originally present in the coal is contained in the mineral fraction. Particularly preferred are enriched mineral fractions containing more than 85% of the mineral material originally present in the coal.

VI. Clean Coal Subfraction

As previously mentioned, all known raw coals contain some degree of sulfur in organic form and inorganic forms, e.g., pyrites and sulfates. It was unexpected to find that the explosive comminution technique of the invention had removed the organic sulfur from at least a portion or subfraction, referred to herein as a "clean coal" component or subfraction of the hydrocarbon fraction of the shattered product. The clean coal component consists of that portion of the hydrocarbonaceous fraction having a particle size of less than about 2 microns.

Studies were conducted using electron microscopes and elemental analysis techniques to confirm the composition of these particles. Although larger particles contain small amounts of organic sulfur and mineral matter, the less than two micron sized particles are pure hydrocarbon containing no minerals or sulfur of any form. This result has been shown to occur with both Illinois-6 coal and with Pittsburgh-8 coal.

The mechanism by which this clean hydrocarbon fraction results is not fully understood. It is likely to be related to the kinetic and/or stoichiometric relation which exists between the hydrocarbon, supercritical water, the minerals and the sulfur particles at the extremely high energy and short lived conditions across the expansion unit of the reactor. This result is not attributable simply to size reduction, as shown by the fact that the removal of organic sulfur does not occur with ball milled coal, regardless of particle size.

The precise chemical and structural nature of the shattered product are not known. It is known, as shown by these chemical and physicochemical results set forth above, that the shattered product and specifically the hydrocarbon fraction of the shattered product embody a form of coal previously unknown. The solubility, the oxidation rate, the density and the complete absence of organic sulfur show that the shattered hydrocarbon product is different from known coals and from coals conventionally ground to equivalent particle size.

Scissionability and Separability Studies

Two samples of totally condensed, explosively shattered product were produced and collected. The first sample was produced by the continuous heating and explosive expansion of an aqueous slurry of Illinois-6 coal from the supercritical conditions of 6400 psi and 830° F. to ambient conditions. All of the resultant product was collected and condensed. The second sample represented the continuous explosive shattering of Illinois-6 coal from the subcritical conditions of 2200 psi and 570° F.

The size distribution of the feed and each of the resultant products are set forth in Tables IX, X, and XI below.

TABLE IX

VOLUME SIZE DISTRIBUTION OF FEED

| Size Range μm | Volume Percent |
|---|---|
| 178–125 | 0.0 |
| 125–88 | 16.5 |
| 88–62 | 17.9 |
| 62–44 | 16.4 |
| 44–31 | 11.1 |
| 31–22 | 8.9 |
| 22–16 | 8.2 |
| 16–11 | 5.8 |

TABLE IX-continued

| VOLUME SIZE DISTRIBUTION OF FEED | |
|---|---|
| Size Range μm | Volume Percent |
| 11-7.8 | 0.0 |
| 7.8-5.5 | 3.1 |
| 5.5-3.9 | 6.4 |
| 3.9-2.8 | 2.9 |
| 2.8-1.9 | 1.5 |
| 1.9-1.4 | 0.7 |

Mean particle size = 44.7 μm

TABLE X

| VOLUMETRIC SIZE DISTRIBUTION OF PRODUCT SAMPLE - SUB-CRITICAL CONDITIONS - 570° F., 2200 psi | |
|---|---|
| Size Range μm | Volume Percent |
| 178-125 | 0.0 |
| 125-88 | 13.6 |
| 88-62 | 16.6 |
| 62-44 | 14.7 |
| 44-31 | 10.3 |
| 31-22 | 9.8 |
| 22-16 | 8.6 |
| 16-11 | 8.7 |
| 11-7.8 | 1.0 |
| 7.8-5.5 | 3.1 |
| 5.5-3.9 | 7.0 |
| 3.9-2.8 | 3.3 |
| 2.8-1.9 | 1.8 |
| 1.9-1.4 | 0.9 |

Mean particle size = 36.9 μm

TABLE XI

| VOLUMETRIC SIZE DISTRIBUTION OF PRODUCT SAMPLE - SUPER-CRITICAL CONDITIONS - 830° F., 6400 psi | |
|---|---|
| Size Range μm | Volume Percent |
| 178-125 | 0.0 |
| 125-88 | 0.0 |
| 88-62 | 0.0 |
| 62-44 | 0.0 |
| 44-31 | 0.0 |
| 31-22 | 0.0 |
| 22-16 | 0.0 |
| 16-11 | 11.3 |
| 11-7.8 | 0.0 |
| 7.8-5.5 | 5.3 |
| 5.5-3.9 | 33.0 |
| 3.9-2.8 | 20.3 |
| 2.8-1.9 | 19.9 |
| 1.9-1.4 | 9.9 |

Mean particle size = 3.84 μm

In addition, portions of each of the product samples collected were centrifuged to remove excess water. The resultant concentrated portions were then examined under a microscope. The microscopical particle properties of transparency, color reflectance, refractive index, birefringence, pleochroism, fluorescence, size, shape, surface texture, magnetism, solubility, melting point and density were, to the extent possible, observed. It was observed that the samples produced by subcritical conditions were of large particle size as evidenced by the data in Table X. In addition, these particles showed an appreciable number of unscissioned mineral and hydrocarbonaceous particles. Substantially all of the particles produced by supercritical conditions were small in size (Table XI) and the mineral and hydrocarbonaceous particles were scissioned.

The remaining portion of the supercritical product sample was allowed to stand for 3-4 weeks to permit the sample to gravity settle. Two distinct, upper and lower layers were produced, separated and analyzed. The results obtained are set forth in Table XII below. This data further illustrates the scissioning and separation of the mineral and hydrocarbonaceous material that was obtained by subjecting the coal to explosive comminution at supercritical conditions.

TABLE XII

| ASH ANALYSIS AND X-RAY DIFFRACTION RESULTS - EXPLOSIVELY SHATTERED PRODUCT | | | | |
|---|---|---|---|---|
| | | Explosively Shattered Product | Upper Layer | Lower Layer |
| Approximate Relative Percent Material in Ash | Percent Ash | 13.2 | 8.6 | 25.9 |
| | Quartz | 61.1 | 65.0 | 65.0 |
| | $Fe_2O_3$ | 18.4 | 18.3 | 16.6 |
| | $FeS_2$ | 12.6 | 13.3 | 13.3 |
| | $Ca_{12}Al_{14}O_{33}$ | 7.7 | 3.3 | 5.0 |
| | Clay | | | |

COMPARATIVE EXAMPLES

The preceding data was obtained from a continuous flow pilot plant wherein a coal water slurry is directly heated by an electric current passing through the slurry, i.e. the slurry acts as a resistance heater. This apparatus cannot be utilized, however, for all possible combinations of temperature and pressure. For example, the slurry resistance heater cannot be used to heat a slurry to a high temperature unless the pressure imposed upon the system is sufficient to maintain the water in a liquid or supercritical state. In other words, the continuous flow pilot plant cannot adequately generate a superheated steam system.

Accordingly, a test procedure was developed to determine whether it was possible to accurately predict, from data obtained in the prior art superpressured water and superheated steam regimes, the results obtained by applicants when operating at supercritical pressures and temperatures. The test procedure is initiated by placing a slurry of coal and water of known weight, volume and solids content in a thin walled, open topped copper container. The container is then inserted into a circular opening, sized to receive the container, in a metal block maintained at a predetermined high temperature. The sample is then sealed within the cavity by placing a metallic seal over the opening in the block. Convection and radiation from the metallic block function to heat the sample within the copper container. Sample temperature, sample pressure and block temperature are monitored. The seal is then ruptured, on demand, by contact with a circular cutting device, at a predetermined time, temperature or pressure. When ruptured, the sample instantaneously expands or explodes from the cavity into a collection chamber. The resultant product is condensed and quantitatively recovered and analyzed.

The feed coal utilized in each of these tests is an Illinois-6 coal having an average particle size of 50.6 micrometers. The coal was added to the container as a slurry of 20 wt.% coal in water.

Figure 11:
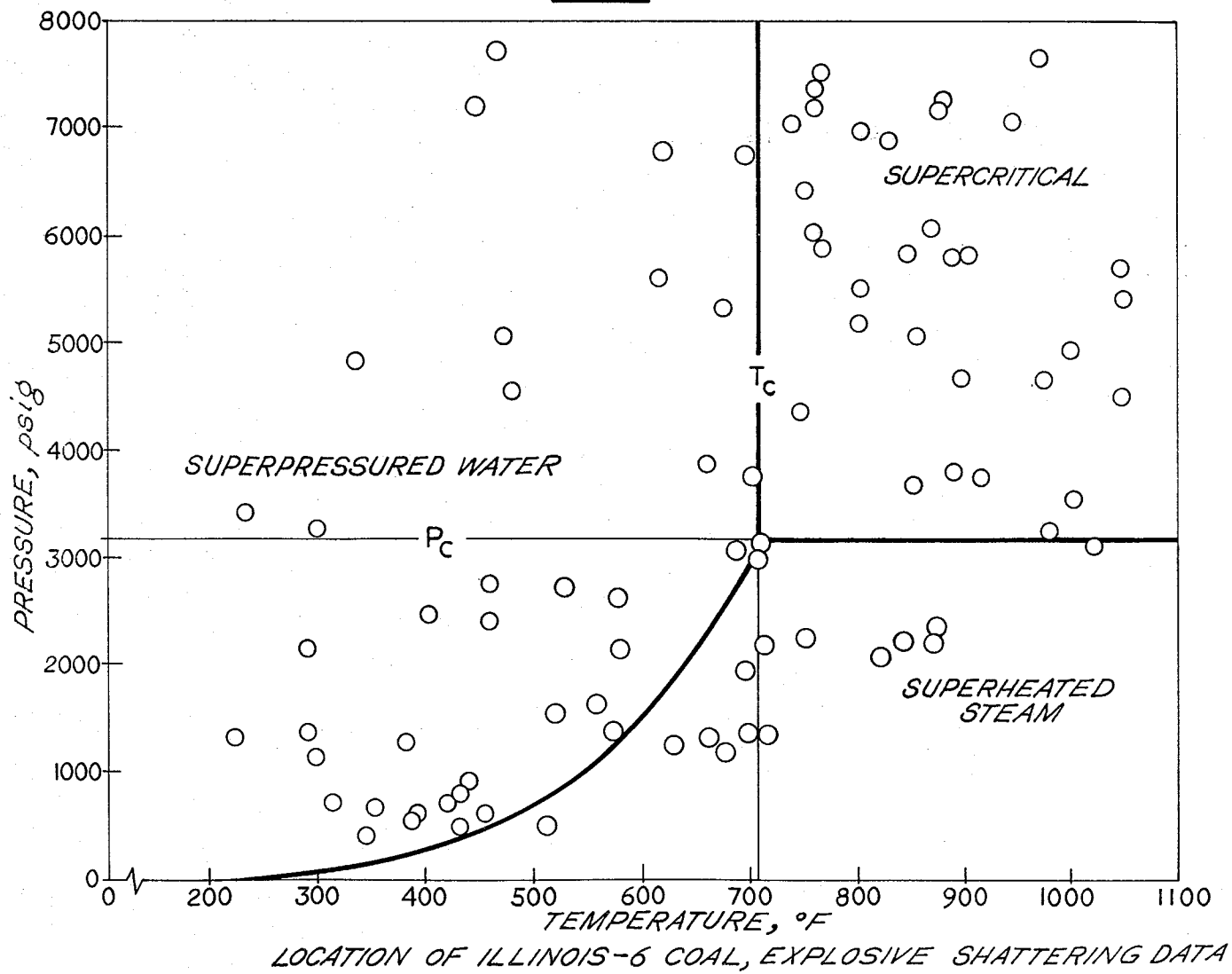
FIG. 11 is a plot graphically representing the various data points utilized while conducting experiments comparing the supercritical fluid thermodynamic regime comprising the present invention with the prior art thermodynamic regimes of superpressured water and superheated steam.

The specific temperatures and pressures obtained by placing the coal water slurry for predetermined time periods in a metal block maintained at a temperature of about 1000° F., 1200° F. and 1400° F. and the mean particle size of the final exploded or comminuted product are set forth in Tables XIII, XIV and XV below. In addition, each of the specific temperature and pressure conditions tested and the relationship of the conditions to the thermodynamic regimes of supercritical, superpressured water and superheated steam are graphically represented in FIG. 11.

TABLE XIII

1000° F. Block Temperature

| Wt. Set, gms | Value Identification | Time Set, Minutes 1 | 2 | 3 | 5 | 7 |
|---|---|---|---|---|---|---|
| 4 | Run Number | 99 | 85 | 93 | 109 | 98 |
| | Pressure, psig | 412 | 504 | 1200 | 1332 | 1256 |
| | Sample Temp., °F. | 345 | 513 | 677 | 662 | 628 |
| | Block Temp., °F. | 1006 | 1038 | 1053 | 1000 | 1003 |
| | Sample Wt., gm | 4.34 | 4.01 | 4.04 | 3.82 | 4.13 |
| | Mean Size, μm | 19.8 | 30.4 | 27.6 | 24.1 | 21.0 |
| 6 | Run Number | In- | 86 | 94 | 100* 102* | 101 |
| | Pressure, psig | signifi- | 800 | 1392 | 1952 2284 | 2208 |
| | Sample Temp., °F. | cant | 431 | 572 | 694 750 | 710 |
| | Block Temp., °F. | Tem- | 989 | 1000 | 1000 1013 | 985 |
| | Sample Wt., gm | pera- | 6.01 | 6.01 | 6.10 6.24 | 6.07 |
| | Mean Size, μm | ture | 31.4 | 27.1 | 24.3 23.4 | 22.3 |
| 8 | Run Number | Dif- | 87 | 95 | 104 | 103 |
| | Pressure, psig | fer- | 568 | 1560 | 3000 | 3176 |
| | Sample Temp., °F. | ences | 386 | 520 | 705 | 708 |
| | Block Temp., °F. | | 1011 | 1004 | 987 | 985 |
| | Sample Wt., gm | | 8.02 | 8.02 | 8.19 | 8.08 |
| | Mean Size, μm | | 35.8 | 30.1 | 23.0 | 22.3 |
| 10 | Run Number | | 88 | 105 | 107 | 106 |

TABLE XIII-continued

1000° F. Block Temperature

| Wt. Set, gms | Value Identification | Time Set, Minutes 1 | 2 | 3 | 5 | 7 |
|---|---|---|---|---|---|---|
| | Pressure, psig | | 948 | 3888 | 3768 | 4400 |
| | Sample Temp., °F. | | 438 | 658 | 701 | 744 |
| | Block Temp., °F. | | 998 | 989 | 993 | 1023 |
| | Sample Wt., gm | | 10.02 | 10.16 | 10.13 | 10.17 |
| | Mean Size, μm | | 31.4 | 20.7 | 21.6 | 17.1 |
| 12 | Run Number | 89 | 90 | 108 | 110 | 111 |
| | Pressure, psig | 680 | 728 | 2784 | 5200 | 5520 |
| | Sample Temp., °F. | 354 | 314 | 458 | 799 | 799 |
| | Block Temp., °F. | 1004 | 1004 | 998 | 1013 | 1004 |
| | Sample Wt., gm | 12.04 | 12.01 | 12.02 | 12.08 | 11.96 |
| | Mean Size, μm | 21.2 | 34.1 | 23.9 | 24.7 | 7.09 |
| 14 | Run Number | 92 | 91 | 112 | 113 | 114 |
| | Pressure, psig | 1320 | 2400 | 5632 | 6576 | 6432 |
| | Sample Temp., °F. | 221 | 458 | 611 | 756 | 744 |
| | Block Temp., °F. | 1002 | 1006 | 975 | 996 | 981 |
| | Sample Wt., gm | 14.01 | 14.03 | 14.30 | 14.15 | 14.19 |
| | Mean Size, μm | 34.2 | 27.6 | 26.3 | 23.3 | 21.7 |
| 16 | Run Number | 115 | 116 | 117 | 118 | 119 |
| | Pressure, psig | 3280 | 4576 | 5904 | 7216 | 7460 |
| | Sample Temp., °F. | 296 | 475 | 763 | 756 | 756 |
| | Block Temp., °F. | 1006 | 1002 | 1002 | 996 | 998 |
| | Sample Wt., gm | 16.04 | 16.13 | 15.99 | 16.02 | 16.21 |
| | Mean Size, μm | 29.4 | 26.2 | 25.0 | 21.0 | 22.1 |

*Attempted duplicate runs

TABLE XIV

1200° F. Block Temperature

| Wt. Set, gms | Value Identification | Time Set, Minutes 1 | 2 | 3 | 5 | 7 |
|---|---|---|---|---|---|---|
| 4 | Run Number | 74 76 | 75 81 | 120 | 121 | 122 |
| | Pressure, psig | 640 512 | 1392 1428 | 2216 | 2384 | 2256 |
| | Sample Temp., °F. | 455 431 | 699 714 | 867 | 869 | 842 |
| | Block Temp., °F. | 1171 1206 | 1207 1186 | 1192 | 1165 | 1142 |
| | Sample Wt., gm | 4.01 4.02 | 4.04 4.01 | 3.95 | 3.97 | 4.01 |
| | Mean Size, μm | 19.8 28.5 | 22.4 28.0 | 19.6 | 17.8 | 21.0 |
| 6 | Run Number | 77 | 82 | 123 | 124 | 125 |
| | Pressure, psig | 720 | 1656 | 3760 | 3824 | 3680 |
| | Sample Temp., °F. | 417 | 557 | 913 | 884 | 850 |
| | Block Temp., °F. | 1214 | 1190 | 1205 | 1172 | 1165 |
| | Sample Wt., gm | 6.03 | 6.01 | 5.96 | 5.91 | 5.96 |
| | Mean Size, μm | 28.8 | 27.9 | 17.2 | 13.8 | 7.69 |
| 8 | Run Number | 78 | 83 | 126 | 127 | 129 |
| | Pressure, psig | 620 | 2640 | 4696 | 5856 | 5088 |
| | Sample Temp., °F. | 393 | 576 | 892 | 899 | 850 |
| | Block Temp., °F. | 1197 | 1193 | 1165 | 1173 | 1104 |
| | Sample Wt., gm | 8.01 | 8.03 | 8.21 | 8.08 | 8.07 |
| | Mean Size, μm | 34.6 | 20.3 | 16.3 | 15.8 | 15.4 |
| 10 | Run Number | 128 | 84 | 130 131 | 132 | 160 |
| | Pressure, psig | 1144 | 5360 | 5776 5856 | 7064 | 7240 |
| | Sample Temp., °F. | 296 | 669 | 884 842 | 943 | 825 |
| | Block Temp., °F. | 1158 | 1207 | 1212 1159 | 1199 | 1180 |
| | Sample Wt., gm | 10.14 | 10.01 | 10.00 10.00 | 9.99 | 10.01 |
| | Mean Size, μm | 30.6 | 17.6 | 15.5 15.7 | 17.6 | 12.7 |
| 12 | Run Number | 79 | 133 | 134 135 | 161 | |
| | Pressure, psig | 1288 | 5072 | 7008 7300 | 7200 | |
| | Sample Temp., °F. | 379 | 467 | 799 871 | 870 | |
| | Block Temp., °F. | 1192 | 1184 | 1163 1159 | 1235 | |
| | Sample Wt., gm | 12.03 | 12.09 | 12.20 12.25 | 12.00 | |
| | Mean Size, μm | 33.5 | 23.8 | 18.3 19.3 | 13.2 | |
| 14 | Run Number | 80 | 136 | 137 | | |
| | Pressure, psig | 2160 | 7060 | 7580 | | |
| | Sample Temp., °F. | 287 | 735 | 761 | | |
| | Block Temp., °F. | 1180 | 1161 | 1159 | | |
| | Sample Wt., gm | 14.01 | 14.18 | 14.07 | Pressure Would Exceed | |
| | Mean Size, μm | 31.4 | 20.7 | 18.2 | Equipment Safety | |
| 16 | Run Number | 138 159 | 162 | | Limitations | |
| | Pressure, psig | 4832 7760 | 6800 | | | |
| | Sample Temp., °F. | 332 460 | 615 | | | |
| | Block Temp., °F. | 1201 1250 | 1190 | | | |
| | Sample Wt., gm | 16.21 16.36 | 16.01 | | | |
| | Mean Size, μm | 39.0 21.0 | 15.2 | | | |

TABLE XV

1400° F. Block Temperature

| Wt. Set, gms | Value Identification | Time Set, Minutes 1 | 2 | 3 | 5 | | 7 |
|---|---|---|---|---|---|---|---|
| 4 | Run Number | 139 | 96 | 140 | 141 | | 155 |
| | Pressure, psig | 2168 | 3136 | 3264 | 3584 | | 3904 |
| | Sample Temp., °F. | 578 | 1019 | 977 | 998 | | 1010 |
| | Block Temp., °F. | 1358 | 1379 | 1312 | 1330 | | 1329 |
| | Sample Wt., gm | 4.50 | 4.07 | 4.07 | 4.12 | | 3.98 |
| | Mean Size, μm | 20.1 | 11.8 | 15.1 | 13.0 | | 15.5 |
| 6 | Run Number | 142 | 148 | 97 | 152 | 153 | 154 |
| | Pressure, psig | 3080 | 4680 | 2096 | 4528 | 5740 | 5160 |
| | Sample Temp., °F. | 684 | 970 | 820 | 1044 | 1040 | 1025 |
| | Block Temp., °F. | 1308 | 1336 | 1317 | 1410 | 1350 | 1358 |
| | Sample Wt., gm | 6.13 | 6.02 | 6.32 | 6.11 | 6.03 | 6.08 |
| | Mean Size, μm | 24.7 | 16.1 | 24.3 | 12.1 | 13.4 | 28.3 |
| 8 | Run Number | 143 | 149 | 156 | 157 | | |
| | Pressure, psig | 2744 | 6096 | 4960 | 5440 | | |
| | Sample Temp., °F. | 526 | 865 | 994 | 1045 | | |
| | Block Temp., °F. | 1330 | 1373 | 1375 | 1358 | | |
| | Sample Wt., gm | 8.04 | 8.20 | 8.19 | 8.27 | | |
| | Mean Size, μm | 26.1 | 15.2 | 7.24 | 13.0 | | |
| 10 | Run Number | 144 | 150 | | | | |
| | Pressure, psig | 2448 | 6904 | | | | |
| | Sample Temp., °F. | 408 | 825 | | | | |
| | Block Temp., °F. | 1394 | 1351 | | | | |
| | Sample Wt., gm | 10.19 | 10.08 | | | | |
| 12 | Mean Size, μm | 29.6 | 16.3 | Pressure Would Exceed Equipment Safety Limitations | | | |
| | Run Number | 145 | 151 | | | | |
| | Pressure, psig | 1360 | 6768 | | | | |
| | Sample Temp., °F. | 287 | 690 | | | | |
| | Block Temp., °F. | 1345 | 1330 | | | | |
| | Sample Wt., gm | 12.07 | 12.01 | | | | |
| | Mean Size, μm | 34.6 | 19.0 | | | | |
| 14 | Run Number | 146 | 158 | | | | |
| | Pressure, psig | 3440 | 7680 | | | | |
| | Sample Temp., °F. | 230 | 965 | | | | |
| | Block Temp., °F. | 1330 | 1375 | | | | |
| | Sample Wt., gm | 14.11 | 14.05 | | | | |
| | Mean Size, μm | 30.9 | 13.0 | | | | |
| 16 | Run Number | 147 | | | | | |
| | Pressure, psig | 7240 | | | | | |
| | Sample Temp., °F. | 442 | | | | | |
| | Block Temp., °F. | 1351 | | | | | |
| | Sample Wt., gm | 16.04 | | | | | |
| | Mean Size, μm | 19.4 | | | | | |

The temperature, pressure and particle size data presented in Tables XIII to XV was segregated and retabulated below in accordance with the specific thermodynamic regimes (superpressured water, superheated steam or supercritical) applicable to a particular data point. The data for the superpressured water appears in Table XVI, the data for superheated steam appears in Table XVII and the data for supercritical conditions appears in Table XVIII.

TABLE XVI

MEASURED VALUES: SUPERPRESSURED WATER REGION VS. VOLUMETRIC MEAN PARTICLE SIZE

| Run Number | Pressure, psig | Temperature, F. | Time, Minutes | Size, Micrometers |
|---|---|---|---|---|
| 74 | 640 | 455 | 1.0 | 19.8 |
| 76 | 512 | 431 | 1.0 | 28.5 |
| 77 | 720 | 417 | 1.0 | 28.8 |
| 78 | 620 | 393 | 1.0 | 34.6 |
| 79 | 1288 | 379 | 1.0 | 33.5 |
| 80 | 2160 | 287 | 1.0 | 31.4 |
| 82 | 1656 | 557 | 2.0 | 27.9 |
| 83 | 2640 | 576 | 2.0 | 20.3 |
| 84 | 5360 | 669 | 2.0 | 17.6 |
| 86 | 800 | 431 | 2.0 | 31.4 |
| 87 | 568 | 386 | 2.0 | 35.8 |
| 88 | 948 | 438 | 2.0 | 31.4 |
| 89 | 680 | 354 | 1.0 | 21.2 |
| 90 | 728 | 314 | 2.0 | 34.1 |
| 91 | 2400 | 458 | 2.0 | 27.6 |

TABLE XVI-continued

MEASURED VALUES: SUPERPRESSURED WATER REGION VS. VOLUMETRIC MEAN PARTICLE SIZE

| Run Number | Pressure, psig | Temperature, F. | Time, Minutes | Size, Micrometers |
|---|---|---|---|---|
| 92 | 1320 | 221 | 1.0 | 34.2 |
| 94 | 1392 | 572 | 3.0 | 27.1 |
| 95 | 1560 | 520 | 3.0 | 30.1 |
| 99 | 412 | 345 | 1.0 | 19.8 |
| 105 | 3888 | 658 | 3.0 | 20.7 |
| 107 | 3768 | 701 | 5.0 | 21.6 |
| 108 | 2784 | 458 | 3.0 | 23.9 |
| 112 | 5632 | 611 | 3.0 | 26.3 |
| 115 | 3280 | 296 | 1.0 | 29.4 |
| 116 | 4576 | 475 | 2.0 | 26.1 |
| 128 | 1144 | 298 | 1.0 | 30.6 |
| 133 | 5074 | 467 | 2.0 | 23.8 |
| 138 | 4832 | 332 | 1.0 | 39.0 |
| 139 | 2168 | 578 | 1.0 | 20.1 |
| 142 | 3080 | 684 | 1.0 | 24.7 |
| 143 | 2744 | 526 | 1.0 | 26.1 |
| 144 | 2448 | 402 | 1.0 | 29.6 |
| 145 | 1360 | 287 | 1.0 | 34.6 |
| 146 | 3440 | 230 | 1.0 | 30.9 |
| 147 | 7240 | 442 | 1.0 | 19.4 |
| 151 | 6768 | 690 | 2.0 | 19.0 |
| 159 | 7760 | 460 | 1.0 | 21.0 |
| 160 | 6800 | 615 | 2.0 | 12.7 |
| 162 | 6800 | 615 | 2.0 | 15.2 |
| Mean | 2871.5 | 462.4 | 1.69 | 26.41 |
| Std. Dev. | 2193.6 | 133.9 | 0.89 | 6.28 |

TABLE XVII

MEASURED VALUES: SUPERHEATED STEAM VS. VOLUMETRIC MEAN PARTICLE SIZE

| Run Number | Pressure, psig | Temperature, °F. | Time, Minutes | Size, Micrometers |
|---|---|---|---|---|
| 75 | 1392 | 699 | 2.0 | 22.4 |
| 81 | 1428 | 714 | 2.0 | 28.0 |
| 85 | 504 | 513 | 2.0 | 27.6 |
| 93 | 1200 | 677 | 3.0 | 27.6 |
| 96 | 3136 | 1019 | 2.0 | 11.8 |
| 97 | 2096 | 820 | 3.0 | 24.3 |
| 98 | 1256 | 628 | 7.0 | 21.0 |
| 100 | 1952 | 694 | 5.0 | 24.3 |
| 101 | 2208 | 710 | 7.0 | 22.3 |
| 102 | 2284 | 750 | 5.0 | 23.4 |
| 103 | 3176 | 708 | 7.0 | 22.3 |
| 104 | 3000 | 705 | 5.0 | 23.0 |
| 109 | 1332 | 662 | 5.0 | 24.1 |
| 120 | 2216 | 867 | 3.0 | 19.6 |
| 121 | 2384 | 869 | 5.0 | 17.8 |
| 122 | 2256 | 842 | 5.0 | 21.0 |
| Mean | 1988.7 | 742.3 | 4.37 | 22.53 |
| Std. Dev. | 759.0 | 118.1 | 1.96 | 4.02 |

TABLE XVIII

MEASURED VALUES: SUPERCRITICAL WATER REGION VS. VOLUMETRIC MEAN PARTICLE SIZE

| Run Number | Pressure, psig | Temperature, °F. | Time, Minutes | Size, Micrometers |
|---|---|---|---|---|
| 106 | 4400 | 744 | 7.0 | 17.1 |
| 110 | 5200 | 799 | 5.0 | 24.7 |
| 111 | 5520 | 799 | 7.0 | 7.09 |
| 113 | 6576 | 756 | 5.0 | 23.3 |
| 114 | 6432 | 744 | 7.0 | 21.7 |
| 117 | 5904 | 763 | 3.0 | 25.0 |
| 118 | 7216 | 756 | 5.0 | 21.0 |
| 119 | 7460 | 756 | 7.0 | 22.0 |
| 123 | 3760 | 913 | 3.0 | 17.2 |
| 124 | 3824 | 884 | 5.0 | 13.8 |
| 125 | 3680 | 850 | 7.0 | 7.69 |
| 126 | 4696 | 802 | 3.0 | 16.3 |
| 127 | 5856 | 899 | 5.0 | 15.8 |
| 129 | 5088 | 850 | 7.0 | 15.4 |
| 130 | 5776 | 884 | 3.4 | 15.5 |
| 131 | 5856 | 842 | 3.0 | 15.7 |

TABLE XVIII-continued

MEASURED VALUES: SUPERCRITICAL WATER REGION VS. VOLUMETRIC MEAN PARTICLE SIZE

| Run Number | Pressure, psig | Temperature, °F. | Time, Minutes | Size, Micrometers |
|---|---|---|---|---|
| 132 | 7064 | 943 | 5.0 | 17.6 |
| 134 | 7008 | 799 | 3.0 | 18.3 |
| 135 | 7300 | 871 | 3.9 | 19.3 |
| 136 | 7060 | 735 | 2.0 | 20.7 |
| 137 | 7580 | 761 | 3.0 | 18.2 |
| 140 | 3264 | 977 | 3.0 | 15.1 |
| 141 | 3584 | 998 | 5.0 | 13.0 |
| 148 | 4680 | 970 | 2.0 | 16.1 |
| 149 | 6096 | 865 | 2.0 | 15.2 |
| 150 | 6904 | 825 | 2.0 | 16.3 |
| 152 | 4528 | 1044 | 5.0 | 12.1 |
| 153 | 5740 | 1044 | 5.0 | 13.4 |
| 156 | 4960 | 994 | 3.0 | 7.24 |
| 157 | 5440 | 1045 | 5.0 | 13.0 |
| 158 | 7680 | 965 | 2.0 | 13.0 |
| 161 | 7200 | 870 | 5.0 | 13.2 |
| Mean | 5729.1 | 869.8 | 4.32 | 16.28 |
| Std. Dev. | 1322.5 | 97.0 | 1.70 | 4.54 |

The data tabulated in Tables XVI, XVII and XVIII was subjected to computer analysis by a least squares regression analysis program to determine if the measured dependent variable of mean particle size could be correlated in any manner to the measured values of time, pressure and temperature. The independent variables specifically selected in an attempt to develop a correlation having greater than a 90% confidence level are Pressure, P; Temperature, T; Time, $\theta$; Pressure times temperature; Pressure times time; Temperature times time; Pressure squared; Temperature squared; Time squared; Natural logarithm of pressure; Natural logarithm of temperature and Natural logarithm of time.

The correlation obtained for the superpressured water regime (Table XVI) is:

$$\text{Volumetric Mean Particle Size, micrometers} = 38.35929 + 2.9416\left(\text{Ln}\frac{P}{1000}\right) - 5.51285\left(\text{Ln}\frac{T}{100}\right) - 0.40358\left(\frac{P\times T}{100{,}000}\right)$$

where P=pressure, psig and T=temperature, °F.

The correlation coefficient is r=0.7539 with a standard estimate of error $s_e$=4.2992 micrometers.

The analysis of variance table is:

| | Degrees of Freedom | Sum of Squares | Mean Square | F Ratio |
|---|---|---|---|---|
| Regression | 2 | 801.939 | 400.970 | 20.724 |
| Residual | 36 | 696.540 | 19.348 | |

An F ratio greater than 4 indicates that the correlation is statistically significant and reliable. The specific F ratio obtained provides a confidence level greater than 0.999.

The correlation obtained for the superheated steam regime (Table XVII) is:

$$\text{Volumetric Mean Particle Size, micrometers} = 2.12238 + 9.81236\left(\frac{T}{100}\right) - 0.82034\left(\frac{T}{100}\right)^2 - 0.08391\,(\theta)^2$$

where T=temperature, °F. and $\theta$=time, minutes

The correlation coefficient is r=0.9071 with a standard estimate of error $s_e$=2.2254 $\mu$m.

The analysis of variance table is:

| | Degrees of Freedom | Sum of Squares | Mean Square | F Ratio |
|---|---|---|---|---|
| Regression | 3 | 199.078 | 66.359 | 18.581 |
| Residual | 12 | 42.857 | 3.571 | |

The F ratio obtained provided a confidence level greater than 0.999.

The correlation obtained for the supercritical fluid regime (Table XVIII) is:

$$\text{Volumetric Mean Particle Size, micrometers} = 267.50971 + 18.60361\left(\frac{T}{100}\right) + 4.86879\,(\theta) - 0.61985\,(\theta)^2 - 195.05659\left(\text{Ln}\frac{T}{100}\right)$$

where T=temperature, °F. and $\theta$=time, minutes.

The correlation coefficient is r=0.7498 with a standard estimate of error $s_e$=3.2176 $\mu$m.

The analysis of variance table is:

| | Degrees of Freedom | Sum of Squares | Mean Square | F Ratio |
|---|---|---|---|---|
| Regression | 4 | 358.931 | 89.733 | 8.667 |
| Residual | 27 | 279.528 | 10.353 | |

This F ratio obtained provides a confidence level greater than 0.999.

The actual results obtained in the supercritical regime are compared, in Table XIX, to the results that would be predicted from each of these separate correlations developed for the three separate thermodynamic regimes. In addition, each of these correlations are plotted, in graphical form in FIGS. 12 and 13.

TABLE XIX

SUPERCRITICAL REGIME MEASURED DATA COMPARED WITH PREDICTION CALCULATED VALUES FROM CORRELATIONS

| Run Number | Measured Mean Size, Micrometers | Calculated Size, Micrometers: Supercritical | Super-pressured | Superheated |
|---|---|---|---|---|
| 106 | 17.1 | 18.2 | 18.4 | 21.4 |
| 110 | 24.7 | 19.6 | 15.0 | 21.8 |
| 111 | 7.09 | 14.5 | 14.1 | 19.8 |
| 113 | 23.3 | 22.4 | 12.7 | 23.1 |
| 114 | 21.7 | 18.2 | 13.5 | 21.4 |
| 117 | 25.0 | 22.1 | 14.2 | 24.2 |
| 118 | 21.0 | 22.4 | 11.0 | 23.1 |
| 119 | 22.0 | 17.3 | 10.4 | 21.1 |
| 123 | 17.2 | 15.0 | 16.2 | 18.3 |
| 124 | 13.8 | 15.7 | 16.6 | 18.4 |
| 125 | 7.69 | 11.9 | 17.8 | 17.9 |
| 126 | 16.3 | 15.6 | 13.9 | 19.4 |
| 127 | 15.8 | 15.2 | 10.2 | 17.7 |
| 129 | 15.4 | 11.9 | 13.9 | 17.9 |
| 130 | 15.5 | 16.3 | 10.9 | 19.5 |
| 131 | 15.7 | 17.6 | 11.9 | 21.6 |
| 132 | 17.6 | 14.1 | 4.9 | 15.4 |
| 134 | 18.3 | 19.8 | 10.0 | 23.2 |
| 135 | 19.3 | 16.9 | 6.6 | 19.8 |
| 136 | 20.7 | 22.4 | 12.2 | 25.3 |
| 137 | 18.2 | 22.3 | 9.8 | 24.3 |
| 140 | 15.1 | 13.7 | 16.4 | 14.7 |
| 141 | 13.0 | 13.3 | 15.0 | 12.0 |
| 148 | 16.1 | 12.0 | 12.1 | 15.5 |

TABLE XIX-continued

SUPERCRITICAL REGIME MEASURED DATA COMPARED WITH PREDICTION CALCULATED VALUES FROM CORRELATIONS

| Run Number | Measured Mean Size, Micrometers | Calculated Size, Micrometers Supercritical | Super-pressured | Superheated |
|---|---|---|---|---|
| 149 | 15.2 | 14.8 | 10.5 | 21.0 |
| 150 | 16.3 | 16.6 | 9.4 | 22.7 |
| 152 | 12.1 | 13.0 | 10.8 | 8.8 |
| 153 | 13.4 | 13.1 | 6.4 | 8.8 |
| 156 | 7.24 | 13.5 | 10.5 | 13.6 |
| 157 | 13.0 | 13.0 | 7.5 | 8.7 |
| 158 | 13.0 | 12.1 | 1.9 | 15.8 |
| 161 | 13.2 | 16.2 | 7.0 | 19.1 |
| Mean | 16.28 | 16.27 | 11.62 | 18.60 |
| Std. Dev. | 4.54 | 3.40 | 3.82 | 4.55 |
| Student's "t" Value | Basis | −0.012 | 2.893 | −5.816 |
| Probability that data is from different populations | | <0.51 | <0.995 | <0.9995 |

Figure 12:
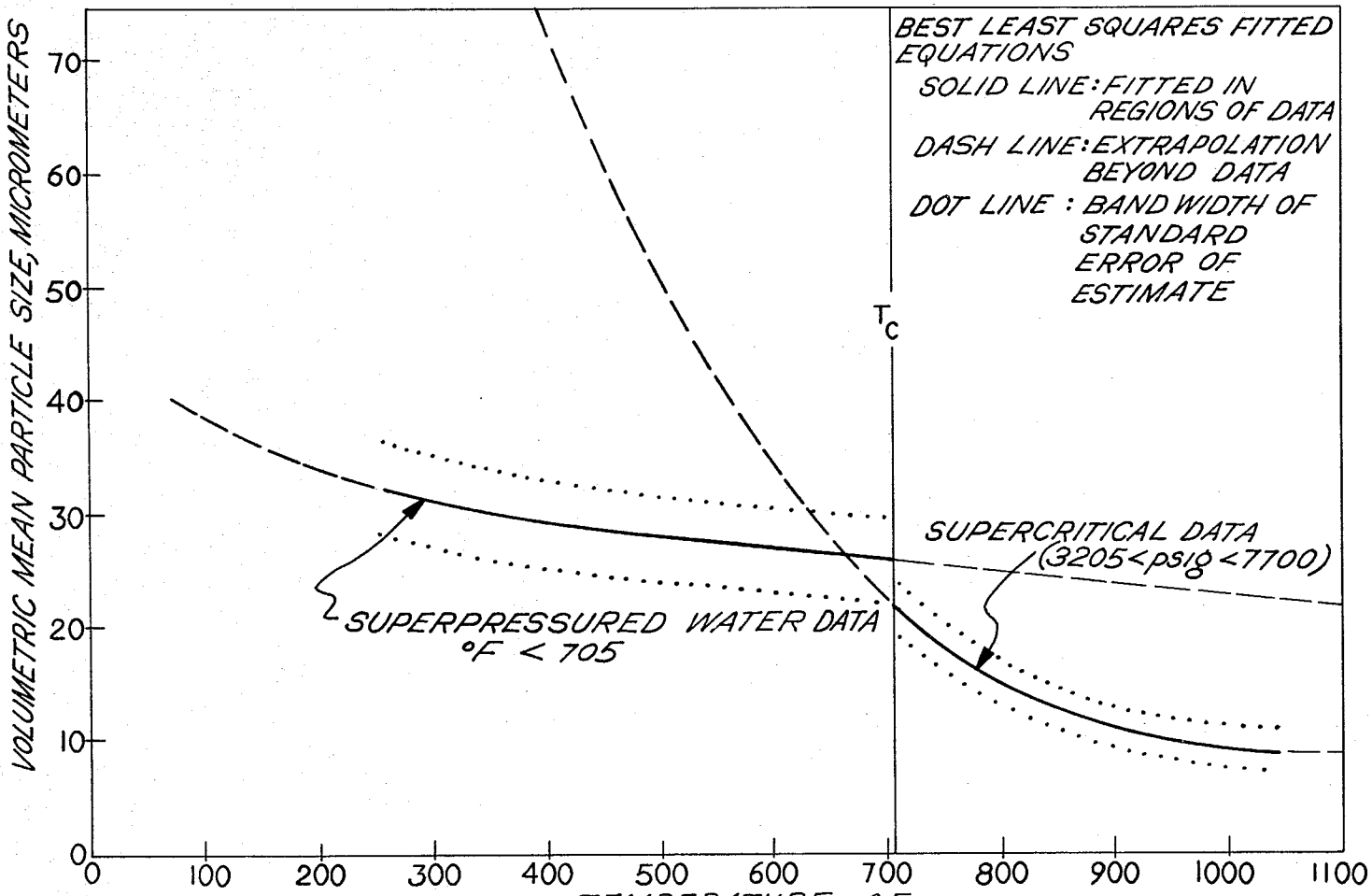
FIG. 12 graphically represents and compares the correlations obtained from the superpressured water and supercritical fluid thermodynamic regimes for the data points set forth in FIG. 11.
Figure 13:
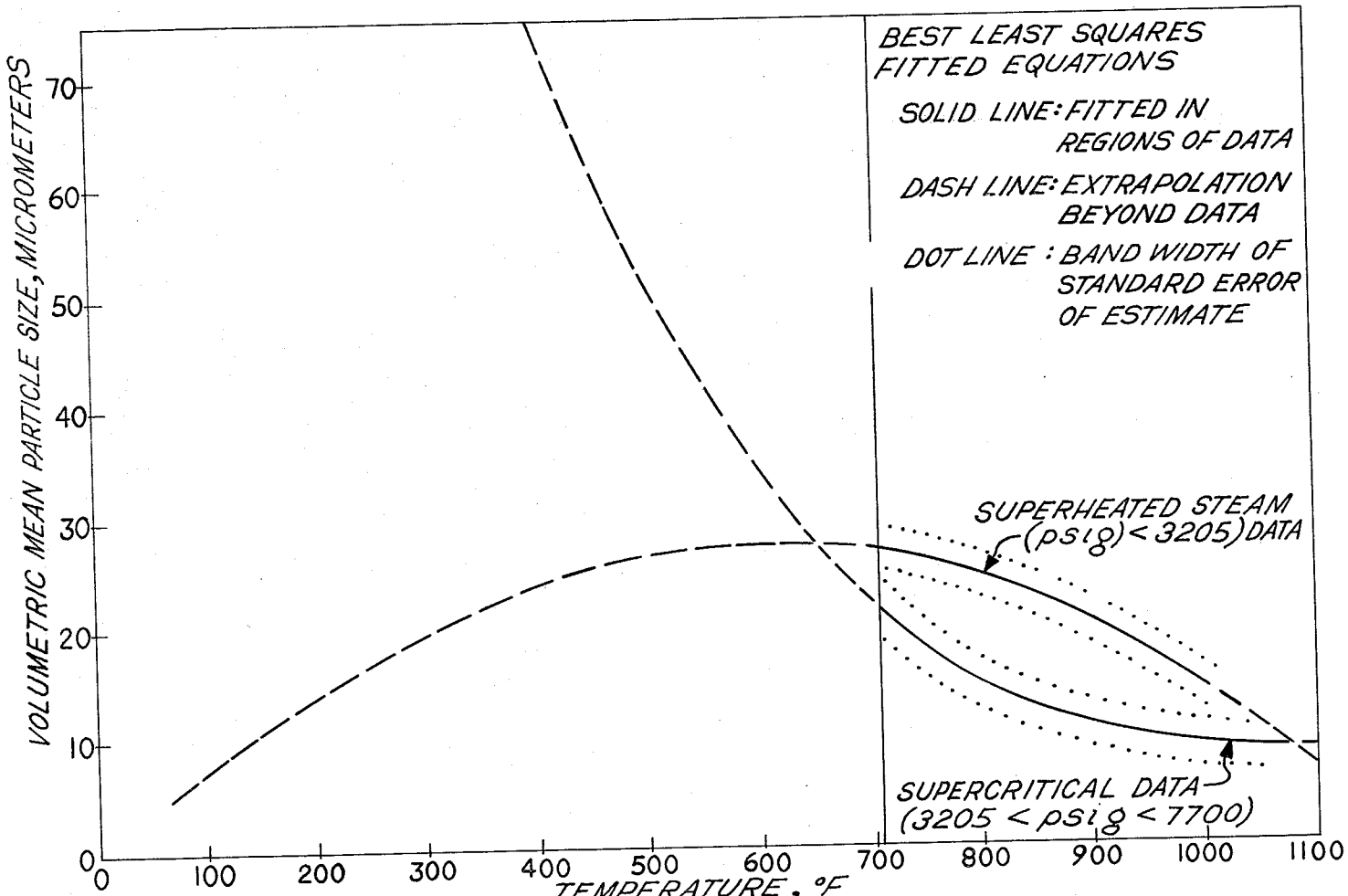
FIG. 13 graphically represents and compares the correlations obtained for the superheated steam and supercritical fluid thermodynamic regimes for the data points set forth in FIG. 11.

As evidenced by the comparisons contained in Table XIX and the graphical representations set forth in FIGS. 12 and 13, it is not possible to accurately predict the results obtained in the supercritical regime from data obtained in the superheated steam and superpressured water regimes. For example, based on the student "t" values set forth, the probability is less than 5 chances in 1000 that the results obtained in the superheated steam and superpressured water regimes can accurately predict the results to be expected in the supercritical regimes.

In addition to evaluating the effect of pressure and temperature on particle size in accordance with the test procedure just described, the effect of the addition of an electrolyte on particle size was investigated. The results obtained are set forth in Table XX below:

TABLE XX

EFFECT OF ELECTROLYTE ON VOLUMETRIC MEAN PARTICLE SIZE REDUCTION

| Run Number | Pressure psig | Temperature °F. | Time, Minutes | g/liter and Electrolyte | Mean Size Micrometers |
|---|---|---|---|---|---|
| 134 | 7008 | 799 | 3.0 | None | 18.3 |
| 135 | 7300 | 871 | 3.9 | None | 19.3 |
| 165 | 7000 | 800 | 2.6 | 0.37 NaCl | 14.6 |
| 166 | 6800 | 695 | 3.0 | 0.37 NaCl | 13.5 |
| 167 | 6250 | 800 | 3.0 | 0.13 NaOH | 5.15 |
| 168 | 5700 | 800 | 3.0 | 0.13 NaOH | 5.23 |
| 169 | 6400 | 800 | 3.0 | 1.2 NaOH | 11.4 |
| 170 | 8650 | 805 | 3.0 | 1.2 NaOH | 7.01 |
| 171 | 7700 | 750 | 3.0 | 1.2 NaOH | 11.5 |

The data contained in Table XX shows that the addition of electrolyte appreciably increases the degree of comminution obtained, i.e. smaller particle sizes are obtained.

DETAILED DESCRIPTION OF PARTICULARLY PREFERRED EMBODIMENT

Figure 5:
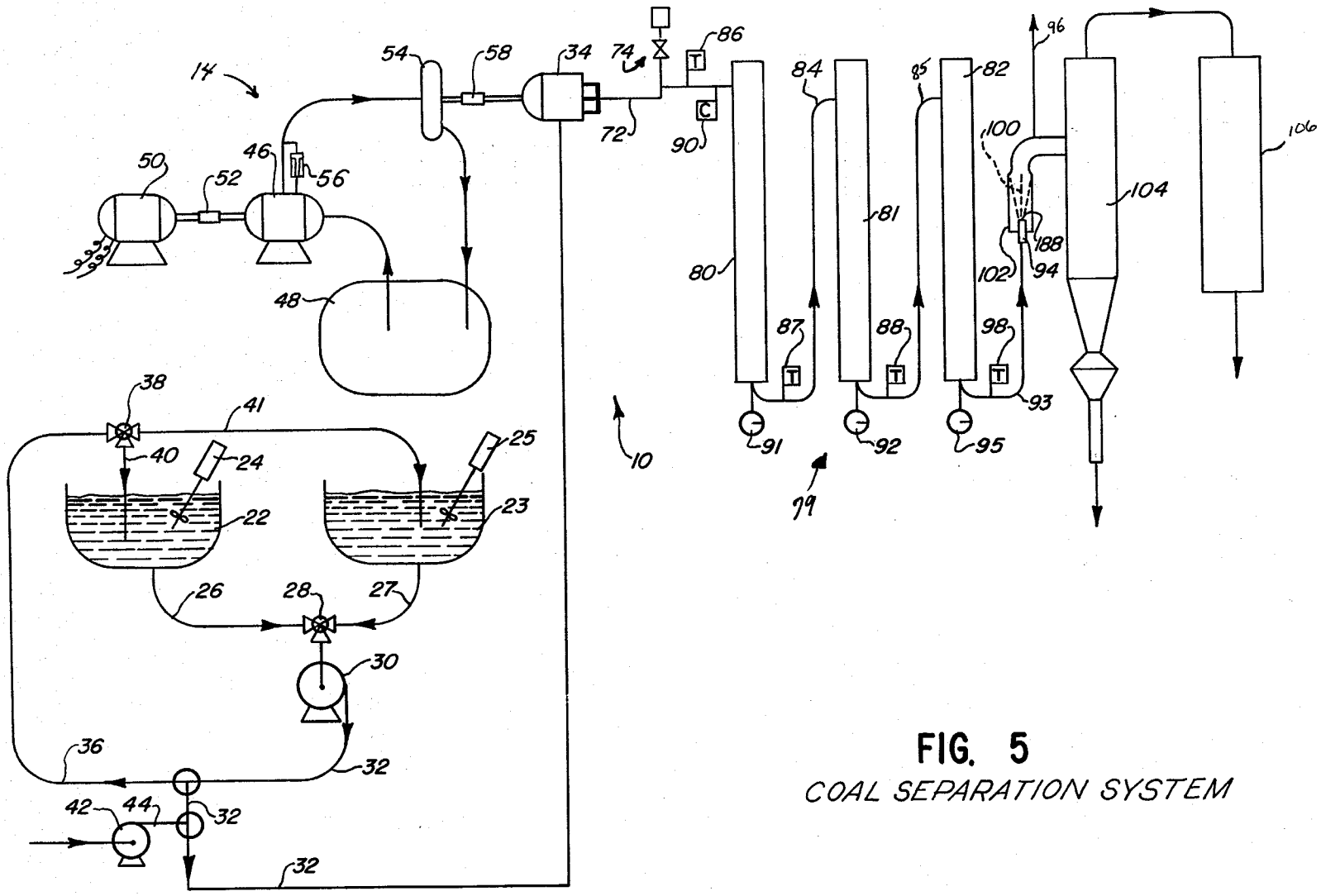
FIG. 5 is a detailed schematic view of a preferred embodiment of the process of the present invention.

FIG. 5 illustrates a particularly preferred embodiment of the process for the present invention for large scale coal comminution and mineral removal. In this process, the overall system 10 includes a pair of slurry holding tanks 22,23 for mixing the pulverized coal with water by mechanical stirrers 24,25. Two tanks 22,23 are preferred so that the system 10 will have an alternate supply as one tank empties. As indicated previously, the system 10 may use any porous or fluid-permeable, friable solid, especially coal, and any liquid which is compatable both with the formation of a slurry and with the components of the process and system 10.

It is noted that coal slurries of greater than about 18 percent solids content form nonnewtonian fluids which are highly viscous and may be difficult to pump. The minimum amount of water which may be used in the invention equals the amount necessary to fill the pores of the coal and the interstitial spaces between the coal particles. Particularly preferred are slurries of coal and water. The slurry composition preferably has a pumpable solids content that varies with coal particle size distribution, but generally of less than about 55 percent, preferably between about 40 and about 55 percent dry coal at ordinary ambient temperature.

Two slurry lines 26,27 lead from the tanks 22,23 to a three way valve 28 where the two lines 26,27 are merged and fed into a circulating pump 30. Circulating pump 30 draws the slurry from either tank 22 or 23 and delivers it via line 32 to the feed pump 34. Line 32 is also connected to an additional slurry line 36 which leads to a second three way valve 38. The second valve 38 separates and directs the flow of line 36 to either tank 22 or 23 via lines 40 or 41.

Lines 26, 27, 32, 36, 40 and 41 form a loop around the tanks 22,23. Circulating pump 30 operates continuously pumping a flow of slurry through a loop with the advantage that the continuous stirring action of mixers 24,25 and pump 30 provide a uniform and consistent composition of the feed. The slurry is drawn off this loop through line 32 by feed pump 34 for delivery to the reactor at a high, constant pressure.

As previously mentioned, it is advantageous to add a predetermined amount of electrolyte solution to the slurry in order to control the electrical resistance of the slurry. In preferred form, FIG. 5 shows a proportioning pump 42 feeding a predetermined amount of electrolyte solution into the slurry through a line 44. The electrolyte is preferably a hydroxide, such as sodium hydroxide, calcium hydroxide or ammonium hydroxide, but may be any electrolyte desired. It is desirable to add the electrolyte solution prior to the feed pump 34 so that proportioning pump 42 does not have to operate in opposition to high operating pressures.

Referring again to FIG. 5, a constant pressure pumping system, generally 14, of the present invention provides a system for delivering slurry to the process at constant pressure. The constant pressure pumping system 14 counteracts sudden or severe pressure changes within the system 10 by increasing the rate of slurry fed to the system 10 as the pressure within the system 10 decreases or, alternatively, decreasing the rate at which slurry is fed to the system 10 as the pressure increases. The constant pressure pumping system 14 is more fully described in a copending application filed herewith, titled "System For Pumping Fluids At Constant Pressure", Ser. No. 127,738, Massey et al., inventors, the disclosure of which is incorporated by reference herein.

The constant pressure pumping system 14 includes a pump 46 preferably driven by a constant speed motor 50 through a drive connection 52 to deliver hydraulic fluid from a reservoir 48 to a hydraulic motor 54. The resultant hydraulic fluid flow is passed through a hydraulic motor 54 which is used to drive feed pump 34 thereby producing a pressure drop across the hydraulic motor. The hydraulic motor 54 produces a driving force which is directly proportional to the amount of pressure drop which is produced across the motor 54.

A pressure sensitive flow control valve 56 is used to control the flow of hydraulic fluid to the hydraulic motor 54. As the pressure drop across the hydraulic motor 54 increases, the pressure sensitive valve 56 decreases the flow of hydraulic fluid through the hydraulic motor 54 in order to decrease the pressure drop across the hydraulic motor 54 to a predetermined level. As the pressure drop across the hydraulic motor 54 decreases, the flow from the hydraulic pump 46 through the hydraulic motor 54 increases. In the preferred embodiment, the flow control valve 56 controls the angle of a swash plate contained within the pump 46 thereby increasing or decreasing the volume of fluid pumped by pump 46 as needed.

The valve varies the amount of hydraulic fluid flowing to the hydraulic motor 54 thereby maintaining a substantially constant pressure drop across the hydraulic motor 54. As a result, a substantially constant driving force is generated by the hydraulic motor 54.

The hydraulic motor 54 acts through a second drive connection 58 to drive the feed pump 34 which has a delivery pressure directly proportional to the amount of driving force generated by the hydraulic motor 54. Since this driving force is maintained constant, the delivery pressure of the fluid, such as a coal-water slurry is also maintained constant; the flow rate of the fluid is reduced as pressure within the system 10 is increased and vice versa. The constant pressure pumping system 14 thereby acts to counteract pressure changes within the system 10, to prevent explosion or damage to the constant pressure pumping system 14 and to protect the integrity of the feed pump 34.

The hydraulic fluid pump 46, the hydraulic motor 54 and the pressure sensing flow control valve 56 form an indirect control of the constant pressure pumping system 14. This constant pressure pumping system 14 is preferred for use in delivering abrasive slurries such as slurries of coal and water because the abrasive feed slurry never contacts the pressure sensing valve 56, thus greatly extending the useful life of the control loop and valve 56.

The feed pump 34 is preferably a positive displacement type of pump, such as a piston or plunger design pump. Pumps of this design are well suited to delivering the high operating pressures necessary for explosive comminution. Because of the highly abrasive nature of coal slurries, it was necessary to provide a specifically designed pump cylinder and valve assembly of the feed pump 34. This pump cylinder assembly is more fully described in an application, Ser. No. 935,991, filed Aug. 22, 1978, and now abandoned, titled "Slurry Pump And Check Valve For Slurry Pump", George et al, inventors, the disclosure of which is incorporated by reference herein.

In order to prevent a dangerous and damaging pressure build up exceeding the design strength of the process, a pressure relief system 74 is attached to slurry line 72 which delivers slurry from the feed pump 34 to the rest of the system 10. It has been found that an abrupt drop in the high pressure in the system 10 or a stoppage of slurry flow through the system causes rapid agglomeration of the hot slurry solids and setting of the particulate coal solids into a solid fused mass within the system 10. The pressure relief system 74 is designed to minimize solids agglomeration and flow stoppage of the coal slurry within the system 10 as described in an application, Ser. No. 935,992, filed Aug. 22, 1978, and now abandoned, titled "Pressure Relief System", Massey et al, inventors, the disclosure of which is incorporated by reference herein.

The pressurized slurry in line 72 is delivered to the heating unit 79 which preferably includes three sequential heating chambers 80, 81 and 82 connected by lines 84 and 85. The temperature of the slurry is preferably measured, for example, by thermocouples 86, 87, 88 and 98 and pressure by gauges 91, 92 and 95 and conductivity by meter 90. The information provided about conditions within the heating units 80, 81 and 82 enables an operator of the system 10 to determine, for example, whether to increase or decrease the amount of energy passed through the slurry by varying the amount of electrolyte mixed into the slurry by proportioning pump 42.

Figure 6:
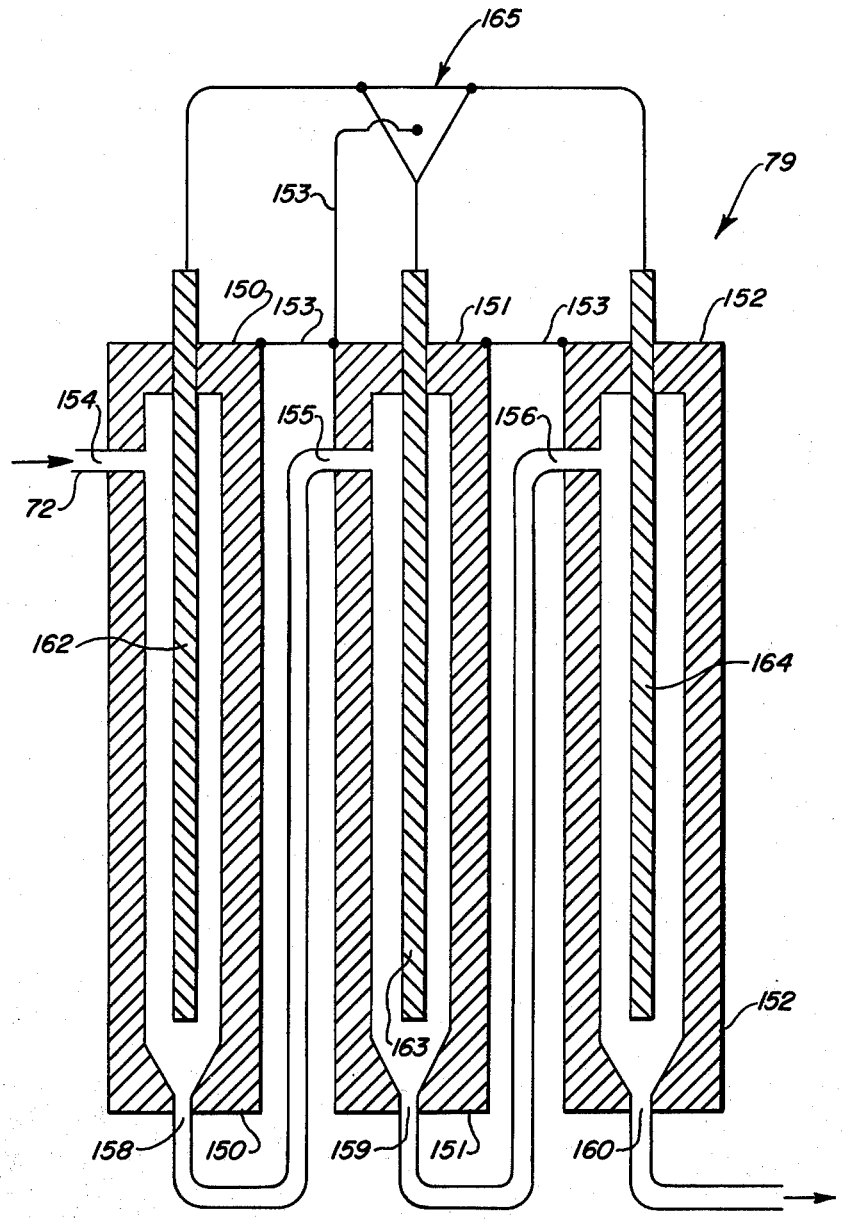
FIG. 6 is a detailed schematic view of a preferred heater design for use in the process of the present invention.

The preferred form for the heating unit 79 is shown in FIG. 6. This heating apparatus and method are more fully described in a copending application filed herewith, Ser. No. 127,736, titled "Method and Apparatus for Heating Liquids and Agglomerating Slurries", Massey et al, inventors, the disclosure of which is incorporated by reference herein. The heating unit 79 comprises electrically conducting cylindrical containers 150, 151 and 152 grounded in a conventional manner by wire 153 to act as an electrode. Each container has an inlet 154, 155 and 156 and an outlet 158, 159 and 160, respectively. Cylindrical electrodes 162, 163 and 164 are mounted within the interior of each cylinder 150, 151 and 152, respectively. The length of the electrodes 162, 163 and 164 is nearly equal to the internal length of the cylinders 150, 151 and 152. The electrodes 162, 163 and 164 are connected preferably to separate phases of a three phase electrical source 165 operating at between about 100 to about 1200 amperes and about 208 to about 480 volts, alternating current when coal is processed at a rate of from 2 to 10 tons/day in unit 79.

Current is passed between electrodes 162, 163 and 164 and the cylinders 150, 151 and 152 as the slurry is passed through the cylinders, thus using the electrical resistance of the slurry as the heating element of the heating units 79. The rate of heating of the slurry is directly proportional to the rate of dissipation of electrical power within the slurry. This system has demonstrated a heating capacity of 5.4 million BTU/hr. $ft^3$ of available heating unit volume or over 1,000,000 BTU/hr $ft^2$ of conductor surface. The rate of dissipation of electrical power is related to the resistance of the slurry ($P=EI=RI^2$) so that, as previously explained, the rate of heating of the slurry, assuming constant voltage E, can be simply and effectively controlled by increasing or decreasing R by means of the amount of electrolyte added via proportioning pump 42.

At relatively high operating temperatures and at high solids concentration coating of the electrodes 162, 163 and 164 by material in the slurry becomes a problem. This coating has a high resistivity which fouls the electrodes 162, 163 and 164 and reduces the flow of electrical current. As a result, the temperature of the slurry drops continuously and loss of process control follows. The severity of this problem varies with the type of coal and the solids content of the slurry. Analysis of this coating indicates it is principally a coal substance of somewhat enhanced ash content. The preferred way of minimizing the coating is to operate at a lower solids content and/or higher temperatures and pressures.

It was necessary to provide a specially designed device to pass large electrical currents to the electrodes 162, 163 and 164 within the heating unit 79 of FIG. 5 at the preferred high temperature and high pressure operating conditions. This device is the subject of co-pending application, filed herewith, Ser. No. 127,737, entitled "Apparatus For Interconnecting A Power Supply To An Electrode Within A Chamber Containing Fluid Maintained At A High Temperature And Pressure", Massey et al., inventors, the disclosure of which is incorporated by reference herein.

The pressurized heated slurry is passed from the heating unit 79 (FIG. 5) through slurry line 93 to the expansion unit 94. As stated previously, at preferred operating temperatures, the necessary residence time is provided by passage of the slurry within the heating chambers 80, 81 and 82, however, slurry line 93 can provide additional residence time, if necessary. Operating conditions at the expansion unit 94 are measured by thermocouple 98 and pressure gauge 95.

Conventional expansion orifices are deficient for use in connection with this invention because they fail to minimize adequately the length of time for the pressure drop to occur (for maximum violence of the explosion and shattering of particles). Specifically, the prior art design is such that the explosive force is partially lost because of a more gradual release of the fluid pressure from within the pores of the coal. In addition, conventional expansion orifices are not designed to withstand the abrasiveness of high temperature, high pressure coal slurries and, as a result, they wear or abrade to become unsuitable for use in a relatively short time. Furthermore, the mixture which is passed from a system for accomplishing explosive comminution at supercritical conditions emerges from the opening of the orifice in an exploding hemispherical pattern, expanding in all directions up to 135° from the direction of flow through the opening. Conventional expansion orifices generally fail in respect to the latter characteristic because they are of a converging/diverging design, similar to a venturi, which design limits the rate of expansion of the slurry and reduces the force of the selective comminution action of the process in the manner previously explained. The adiabatic expansion orifice designed for use with this invention provides for a substantially instantaneous reduction of the pressure in the process. The orifice 94 provides that the slurry will pass across the opening 188 in less than about 10 microseconds, preferably in less than about 1 microsecond and most preferably in less than about 0.3 microsecond. In theory the total amount of time necessary for the pressure drop to occur is equal to the length of time necessary to traverse the orifice length plus the length of time for pressure imposed on the material to equilibrate outside the orifice 94 to downstream pressure conditions. For the orifice design of this invention, that total time is less than about 100 microseconds, preferably less than about 10 microseconds and most preferably less than about 1 microsecond. This is the subject of a copending application, filed herewith, Ser. No. 127,739, entitled "Adiabatic Expansion Orifice Assembly and a Process for Passing a Slurry From a High Pressure Region to a Low Pressure Region", Massey et al., inventors, the disclosure of which is incorporated by reference herein.

A duct 102 is fitted around the orifice 94 to collect the shattered product 100. Duct 102 is preferably designed to provide a minimum distance from the orifice opening 188 which is greater than twenty times the diameter of opening 188. As explained in the above referenced "Adiabatic Expansion Orifice Assembly and a Process for Passing a Slurry From a High Pressure Region to a Low Pressure Region" application, this spacing will avoid interference with the selectivity of the comminution operation of the system 10. The duct 102 may be connected to deliver the product 100 to various subsequent recovery or treatment systems.

The product 100 exiting from the orifice 94 is no longer in slurry form but rather is preferably a water vapor suspension of small hydrocarbonaceous and mineral particles. The water in the slurry will convert, at equilibrium, to steam, liquid water or a mixture thereof depending on the energy content of the water prior to expansion and upon the final pressure, which determines the final temperature. Preferably, the water is completely vaporized in the explosion for maximum shattering and to permit fractionation of the hydrocarbon fraction from the mineral fraction without interference from the droplets of condensate. Therefore, the temperature in the duct 102 is preferably maintained above the dew point of the vapor at the particular pressure existing within the duct 102. The preferred temperature at atmospheric pressure is between about 220° F. and about 275° F.

The product mixture can be drawn from the system 10 at this point by line 96 and used directly or it can be sent through various recovery and processing units as will be explained shortly. The stream of material emerging from the orifice 94 can be passed preferably after separation of the mineral material to a combustion zone, i.e. fired, and used directly as a source of heat. Alternatively, the product could be condensed, recovered and sold to manufacturers for processing and use. Other means of recovery of fuel values may be employed.

In the preferred embodiment shown in FIG. 5, the duct 102 leads to a cyclone 104 having a temperature above the dew point of the vapor, preferably about 250° F. so that no condensation occurs. The hydrocarbonaceous particles of the shattered product have sufficiently smaller size and lower density than the mineral particles of the shattered product so that these two fractions can be fractionated by gravity separation techniques such as through the use of a centrifuge. The hydrocarbon, still suspended in water vapor, is drawn off and sent to condensing, drying, combustion or other processing units 106. In a preferred embodiment, the hydrocarbonaceous particles can be admixed with a liquid fuel, such as gasoline, fuel oil, residual oil, etc., to extend the fuel value of the liquid fuel.

Because of the difference in the density of the hydrocarbon particles versus the mineral particles as produced by this invention, the cyclone 104 can fractionate the mineral particle fraction having a mean particle size of about 3 microns in diameter from the fraction of hydrocarbon particles having a mean particle size of about 5 microns in diameter.

This fractionation can accomplish the removal of at least a portion of the minerals originally present in the raw feed coal. With a suitable solid scavenger for sulfur, about 85 percent of the sulfur originally present may be removed. Specifically, about 90 percent of the inorganic sulfur and about 80 percent of the organic sulfur may be removed. The minerals and solid sulfur scavenging compounds are drawn off the bottom of the cyclone and provide a potential source of several elements, including iron, silicon, sulfur, vanadium, germanium and uranium. Alumina and quartz are also potentially useful by-products.

The above description relates to a preferred embodiment of the invention. However, alternative configurations and modifications are possible within the scope of the invention. For example, different pumps or pumping systems may be designed to produce the necessary reactor pressure. Methods of heating the slurry to supercritical conditions, other than passing an electric current through the slurry, may be devised. The heating unit 79 may consist of a single chamber, rather than the three chambers 80, 81 and 82 as shown. Different liquid solutions may be used to make the slurry. For example, it may be desirable in some instances to use a liquefied gas in forming the slurry and to heat the slurry by simply allowing the slurry to reach ambient temperature. Solids other than coals, such as coke or coal char may be used in making the slurry. Gasification reactors or other reactors may be adapted to receive the shattered product directly from the nozzle 96. Therefore, the subject matter of the invention is to be limited only by the following claims and their equivalents:

We claim as our invention:

1. A method for separating a porous hydrocarbonaceous solid containing an admixture of hydrocarbonaceous components and mineral components into a hydrocarbonaceous enriched fraction and a mineral enriched fraction which comprises (a) comminuting the hydrocarbonaceous components of the hydrocarbonaceous solid selectively without substantially comminuting the mineral components therein under conditions sufficient to substantially scission the hydrocarbonaceous components from the mineral components and to produce a mixture of comminuted discrete hydrocarbonaceous particles in admixture with discrete mineral particles wherein the mean particle size of the comminuted hydrocarbonaceous particle is less than about 5 microns in diameter, and the mean particle size of the mineral particles both before and after comminution is substantially unchanged; and (b) separating the resultant product.

2. A method according to claim 1 wherein about 75% by weight of said mineral components in said hydrocarbonaceous solid are removed from said hydrocarbonaceous solid to further define said hydrocarbonaceous enriched fraction.

3. A method according to claim 1 wherein the porous hydrocarbonaceous solid is comminuted by providing a slurry of the hydrocarbonaceous solid in a liquid at a temperature and pressure in excess of the critical pressure and temperature of the liquid; and, rapidly reducing the pressure imposed on the slurry thereby causing the liquid to expand explosively and thereby comminute selectively the hydrocarbonaceous components in the solid.

4. A method according to claim 1 wherein the porous hydrocarbonaceous component is comminuted into a shattered product having a volumetric mean particle size of less than about 5 microns in diameter, by (a) preparing a slurry of a liquid and the hydrocarbonaceous solid;

(b) raising the pressure imposed on said slurry to a pressure above the critical pressure of the liquid to force liquid into the pores of the solid;

(c) raising the temperature of the slurry to a temperature above the critical temperature of the liquid to convert the liquid into a supercritical fluid;

(d) maintaining the slurry above the critical temperature and pressure of the liquid for a length of time sufficient to permit the supercritical fluid to substantially saturate the pores of the solid; and (e) substantially instantaneously reducing, in an expansion zone, the pressure imposed on said slurry to a second lower pressure to provide a pressure differential between the supercritical fluid within the solids and the surface of the solids sufficient to provide the shattered product.

5. The method according to claim 4 wherein said discrete hydrocarbonaceous particles includes a subfraction consisting essentially of hydrocarbonaceous particles, substantially free of sulfur, having a volumetric mean particle size of less than about 2 microns in diameter.

6. The method according to claim 4 wherein said liquid is water and said hydrocarbonaceous solid is coal.

7. The method according to claim 6 wherein said first predetermined pressure is between about 4,000 psia and about 16,000 psia.

8. The method according to claim 6 wherein said first predetermined temperature is between about 750° F. and about 950° F.

9. The method according to claim 6 wherein said first determined pressure is between about 4,000 psia and about 16,000 psia and said first predetermined temperature is between about 750° F. and about 950° F.

10. The method according to claim 4 wherein said slurry is maintained at supercritical conditions for less than about 15 seconds.

11. The method according to claim 4 wherein the pressure in the expansion zone is substantially ambient pressure and the temperature in the expansion zone is maintained at a temperature higher than the dew point of the vapor at the pressure of the expansion zone.

12. The method according to claim 11 wherein said temperature is about 225°-275° F.

13. The method according to claim 4 wherein the pressure imposed on the slurry is reduced to the second pressure in less than about 100 microseconds.

14. The method according to claim 13 wherein said time is less than about 10 microseconds.

15. The method according to claim 14 wherein said time is less than about 1 microsecond.

16. The method of claim 1 wherein said hydrocarbonaceous solid is coal.

17. A method for separating coal comprising an admixture of hydrocarbonaceous components and mineral components into an enriched hydrocarbonaceous fraction relatively free of mineral components and an enriched mineral fraction which comprises (a) comminuting the hydrocarbonaceous components of the coal selectively without substantially comminuting the mineral components therein under conditions sufficient to scission the hydrocarbonaceous components from the mineral components and to produce a mixture of comminuted discrete hydrocarbonaceous particles in admixture with discrete mineral particles wherein the volumetric mean particle size of the comminuted hydrocarbonaceous particles is less than about 5 microns in diameter and the mean particle size of the mineral particles in the coal both before and after comminution is substantially unchanged;

(b) separating the hydrocarbonaceous fraction from the mineral fraction to provide an enriched hydrocarbonaceous fraction and an enriched mineral fraction;

(c) said enriched hydrocarbonaceous fraction further characterized as
(1) having a solubility in a solvent selected from the group consisting of gasoline, benzene, methyl alcohol, carbon tetrachloride and tetralin of about two times to about six times greater than that of the porous hydrocarbonaceous solid;
(2) having a density of about 0.7 to about 0.9 g/cc; and
(3) having an oxidation decomposition rate determined by thermogravimetric analysis in ambient atmosphere which includes a first peak at about 300° C. and a second peak between about 350° and about 450° C., said decomposition rate decreasing to substantially zero between said first peak and said second peak.

18. A method according to claim 17 wherein the coal is comminuted by providing a slurry of the coal in a liquid at a temperature and pressure in excess of the critical pressure and temperature of the fluid; and, rapidly reducing the pressure imposed on the slurry thereby causing the liquid to expand explosively and comminute selectively the hydrocarbonaceous components of the coal.

19. A method according to claim 17 wherein the coal is comminuted into a shattered product having a volumetric mean particle size of less than about 5 microns in diameter, by
(a) preparing a slurry of a liquid and the coal;
(b) raising the pressure imposed on said slurry to a pressure above the critical pressure of the liquid to force liquid into the pores of the coal;
(c) raising the temperature of the slurry to a temperature above the critical temperature of the liquid to convert the liquid into a supercritical fluid;
(d) maintaining the slurry above the critical temperature and pressure of the liquid for a length of time sufficient to permit the supercritical fluid to substantially saturate the pores of the coal; and
(e) substantially instantaneously reducing, in an expansion zone, the pressure imposed on said slurry to a second lower pressure to provide a pressure differential between the supercritical fluid within the coal and the surface of the coal sufficient to provide a shattered product having volumetric mean particle size of less than about 5 microns in diameter.

20. The method according to claim 19 wherein said discrete hydrocarbonaceous particles includes a subfraction consisting essentially of hydrocarbonaceous particles, substantially free of sulfur, having a volumetric mean particle size of less than about 2 microns in diameter.

21. The method according to claim 19 wherein said liquid is water.

22. The method according to claim 21 wherein said first predetermined pressure is between about 4,000 psia and about 16,000 psia.

23. The method according to claim 21 wherein said first predetermined temperature is between about 750° F. and 950° F.

24. The method according to claim 21 wherein said first predetermined pressure is between about 4,000 psia and about 16,000 psia and said first predetermined temperature is between about 750° F. and about 950° F.

25. The method according to claim 19 wherein said slurry is maintained at supercritical conditions for less than about 15 seconds.

26. The method according to claim 19 wherein the pressure in the expansion zone is substantially ambient pressure and the temperature in the expansion zone is maintained at a temperature higher than the dew point of the vapor at the pressure of the expansion zone.

27. The method according to claim 26 wherein said temperature is about 225°–275° F. and said fluid is water.

28. The method according to claim 19 wherein the pressure imposed on the slurry is reduced to the second pressure is less than about 100 microseconds.

29. The method according to claim 28 wherein said time is less than about 10 microseconds.

30. The method according to claim 29 wherein said time is less than about 1 microsecond.

31. A method for comminuting the hydrocarbonaceous material within a porous hydrocarbonaceous solid containing mineral matter into a shattered product wherein the hydrocarbonaceous components in the shattered product have a volumetric mean particle size of less than about 5 microns in diameter which comprises
(a) preparing a slurry of a liquid and the hydrocarbonaceous solid;
(b) raising the pressure and temperature imposed on the slurry to a pressure and temperature above the critical temperature and pressure of the liquid to force liquid into the pores of the solid and to convert the liquid into a supercritical fluid;
(c) maintaining the slurry above the critical temperature and pressure of the liquid for a length of time sufficient to permit the supercritical fluid to substantially saturate the pores of the solid; and
(d) substantially instantaneously reducing the pressure imposed on said slurry to a second lower pressure to provide a pressure differential between the supercritical fluid within the solids and the surface of the solids sufficient to cause the solids to shatter and to provide said shattered product.

32. The method according to claim 31 wherein said liquid is water and said hydrocarbonaceous solid is coal.

33. The method according to claim 32 wherein said first predetermined pressure is between about 4,000 and about 16,000 pounds per square inch absolute.

34. The method according to claim 32 wherein said first predetermined temperature is between about 750° F. and about 950° F.

35. The method according to claim 32 wherein said first predetermined pressure is between about 4,000 psia and about 16,000 psia and said first predetermined temperature is between about 750° F. and about 950° F.

36. The method according to claim 32 wherein said slurry is maintained at supercritical conditions for less than about 15 seconds.

37. The method according to claim 32 wherein the pressure in the expansion zone is substantially ambient pressure and the temperature in the expansion zone is maintained at a temperature higher than the dew point of the vapor at the pressure of the expansion zone.

38. The method according to claim 37 wherein said temperature is about 225°–275° F.

39. The method according to claim 31 wherein the pressure imposed on the slurry is reduced to the second pressure in less than about 100 microseconds.

40. The method according to claim 39 wherein said time is less than about 10 microseconds.

41. The method according to claim 40 wherein said time is less than about 1 microsecond.

42. The method of claim 31 wherein said hydrocarbonaceous solid is coal.

* * * * *

UNITED STATES PATENT AND TRADEMARK OFFICE

CERTIFICATE OF CORRECTION

PATENT NO. : 4,313,737

DATED : February 2, 1982

INVENTOR(S) : Lester G. Massey et al

It is certified that error appears in the above—identified patent and that said Letters Patent is hereby corrected as shown below:

On the title page, assignee should read:

-- CNG Research Company --.

Signed and Sealed this

*Eighth* Day of *June 1982*

[SEAL]

*Attest:*

GERALD J. MOSSINGHOFF

*Attesting Officer*

*Commissioner of Patents and Trademarks*